US012709814B2

(12) United States Patent
Kempler et al.

(10) Patent No.: US 12,709,814 B2
(45) Date of Patent: Aug. 18, 2026

(54) ELECTROCHEMICAL CELL AND PROCESS FOR PRODUCING METAL AND CHLORINE GAS

(71) Applicant: University of Oregon, Eugene, OR (US)

(72) Inventors: Paul Kempler, Eugene, OR (US); Shannon W. Boettcher, Eugene, OR (US); Berkley B. Noble, Alameda, CA (US)

(73) Assignee: University of Oregon, Eugene, OR (US)

( * ) Notice: Subject to any disclaimer, the term of this patent is extended or adjusted under 35 U.S.C. 154(b) by 491 days.

(21) Appl. No.: 18/329,849

(22) Filed: Jun. 6, 2023

(65) Prior Publication Data

US 2023/0392272 A1 Dec. 7, 2023

Related U.S. Application Data

(60) Provisional application No. 63/349,953, filed on Jun. 7, 2022.

(51) Int. Cl.
*C25C 1/06* (2006.01)
*C25B 1/26* (2006.01)
(Continued)

(52) U.S. Cl.
CPC ..... *C25C 1/06* (2013.01); *C25B 1/26* (2013.01); *C25B 9/19* (2021.01); *C25B 9/75* (2021.01);
(Continued)

(58) Field of Classification Search
CPC ..... C25C 1/06
See application file for complete search history.

(56) References Cited

U.S. PATENT DOCUMENTS 1,275,161 A * 8/1918 Estelle ..... C22B 58/00 205/587
1,945,107 A * 1/1934 Cain ..... C25C 1/06 205/587
(Continued)

FOREIGN PATENT DOCUMENTS

DE 102017216564 A1 * 3/2019 ..... C25C 1/06
GB 190302574 A 8/1902
(Continued)

OTHER PUBLICATIONS

Machine translation of DE-102017216564-A1 (Year: 2019).*
(Continued)

*Primary Examiner* — Harry D Wilkins, III
(74) *Attorney, Agent, or Firm* — Klarquist Sparkman, LLP

(57) ABSTRACT

An electrochemical cell for producing metal and chlorine from metal ore and a metal chloride includes a cathode, an anode, and a separator. A catholyte includes (i) water, (ii) a metal hydroxide comprising Q, where Q is an alkali metal, an alkaline earth metal, or a combination thereof, and (iii) suspended metal ore particles comprising $M_xO_y$ where M is a metal and x and y are integers. An anolyte includes (i) water and (ii) a metal chloride comprising Q. An electrowinning process for producing metal and chlorine includes applying a voltage across the electrochemical cell to effect reduction of the $M_xO_y$ in the cathode compartment to provide the metal M and oxidation of chloride ions in the anode compartment to form $Cl_2$ gas.

12 Claims, 17 Drawing Sheets
(10 of 17 Drawing Sheet(s) Filed in Color)

(51) Int. Cl.

| | |
|---|---|
| ***C25B 9/19*** | (2021.01) |
| ***C25B 9/75*** | (2021.01) |
| ***C25B 9/77*** | (2021.01) |
| ***C25C 7/02*** | (2006.01) |
| ***C25C 7/04*** | (2006.01) |
| ***C25C 7/08*** | (2006.01) |

(52) U.S. Cl.
CPC ..... *C25B 9/77* (2021.01); *C25C 7/02* (2013.01); *C25C 7/04* (2013.01); *C25C 7/08* (2013.01)

(56) References Cited

U.S. PATENT DOCUMENTS

| | | | | | |
|---|---|---|---|---|---|
| 4,057,474 | A * | 11/1977 | Kurtz | C25B 1/46 | 205/345 |
| 4,645,578 | A * | 2/1987 | Suarez-Infanzon | C25C 1/12 | 205/618 |
| 8,784,639 | B2 | 7/2014 | Cardarelli et al. | | |
| 2008/0248350 | A1* | 10/2008 | Little | H01M 16/003 | 429/443 |
| 2010/0044243 | A1* | 2/2010 | Cardarelli | C25B 1/26 | 205/592 |
| 2011/0114500 | A1* | 5/2011 | Cardarelli | C25C 7/02 | 205/349 |
| 2011/0120879 | A1* | 5/2011 | Buschmann | C25C 1/12 | 205/348 |
| 2019/0203368 | A1* | 7/2019 | Cam | C02F 1/488 | |
| 2023/0279572 | A1* | 9/2023 | Akolkar | C25C 7/025 | 204/246 |
| 2024/0200217 | A1* | 6/2024 | Kempler | C25C 7/04 | |
| 2024/0376621 | A1* | 11/2024 | Gao | C25C 7/02 | |
| 2025/0051947 | A1* | 2/2025 | Rathert | C25C 1/06 | |
| 2025/0051948 | A1* | 2/2025 | Manser | C25C 1/06 | |
| 2025/0146155 | A1* | 5/2025 | Rathert | C22C 33/02 | |

FOREIGN PATENT DOCUMENTS

| | | | | |
|---|---|---|---|---|
| WO | WO-2008034212 | A1 * | 3/2008 | C25B 1/26 |
| WO | WO-2009114925 | A1 * | 9/2009 | C25B 1/26 |
| WO | WO 2015/013263 | A1 | 1/2015 | |

OTHER PUBLICATIONS

Vass et al, Coupling electrochemical carbon dioxide conversion with value-added anode processes: An emerging paradigm, Current Opinion in Electrochemistry, vol. 25, Feb. 2021, 100621, pp. 1-9 (Year: 2021).*

Lister et al., Chlor-syngas: Coupling of Electrochemical Technologies for Production of Commodity Chemicals, Energy & Fuels, vol. 27, No. 8, Jan. 2013, pp. 4244-4249 (Year: 2013).*

You et al, Innovative Strategies for Electrocatalytic Water Splitting, Accounts of Chemical Research, vol. 51, No. 7, Mar. 2018, pp. 1571-1580 (Year: 2018).*

Koutsoupa et al, Electrolytic Iron Production from Alkaline Bauxite Residue Slurries at Low Temperatures, Johnson Matthey Technology Review, vol. 65, No. 3, Jul. 2021, pp. 366-374 (Year: 2021).*

Lopes et al, Prospects and challenges of the electrochemical reduction of iron oxides in alkaline media for steel production, Frontiers in Materials, vol. 9, Sep. 2022, pp. 1-8 (Year: 2022).*

Lopes et al, Prospects of Using Pseudobrookite as an Iron-Bearing Mineral for the Alkaline Electrolytic Production of Iron, Materials, vol. 15, No. 4, Feb. 2022, 1440 pp. 1-19 (Year: 2022).*

Chen et al, Screening potential anodic chemistry in lieu of the oxygen evolution reaction in electrolysis systems: the road to practical application, Energy & Environmental Science, vol. 16, Oct. 2023, pp. 5771-5791 (Year: 2023).*

Dufek et al, Bench-scale electrochemical system for generation of CO and syn-gas, Journal of Applied Electrochemistry, vol. 41, Mar. 2011, pp. 623-631 (Year: 2011).*

Yuan et al, Electrowinning of Iron in Aqueous Alkaline Solution Using a Rotating Cathode, Journal of the Electrochemical Society, vol. 156, No. 2, Dec. 2008, pp. D64-D69 (Year: 2008).*

Lavelaine de Maubeuge et al., "Iron Production by Electrochemical Reduction of its Oxide for High $CO_2$ Mitigation (IERO)," European Commission—Research Fund for Coal and Steel, final report (Oct. 13, 2016) 112 pages.

LeDuc et al., "Electrolytic Iron Powder from a Caustic Soda Solution," *J. Electrochem. Soc.*, Aug. 1959, 106(8):658-667.

Maihatchi et al., "Electrolytic Iron Production from Alkaline Suspensions of Solid Oxides: Compared Cases of Hematite, Iron Ore and Iron-Rich Bayer Process Residues," *J. Electrochem. Sci. Eng.*, Mar. 9, 2020, 10(2):95-102.

Xie et al., "Electro-Reduction of Hematite using Water as the Redox Mediator†," *Green Chem.*, first published Nov. 29, 2018, 21:198-204.

Zou et al., "Electroreduction of Iron(III) Oxide Pellets to Iron in Alkaline Media: A Typical Shrinking-Core Reaction Process," *Metallurgical and Materials Transactions B*, published Apr. 8, 2015, 46B:1264-1274.

* cited by examiner

-PRIOR ART-

-PRIOR ART-

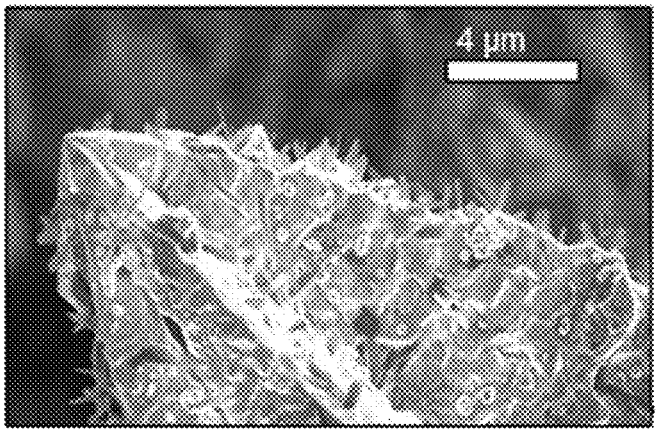
FIG. 18
FIG. 19A
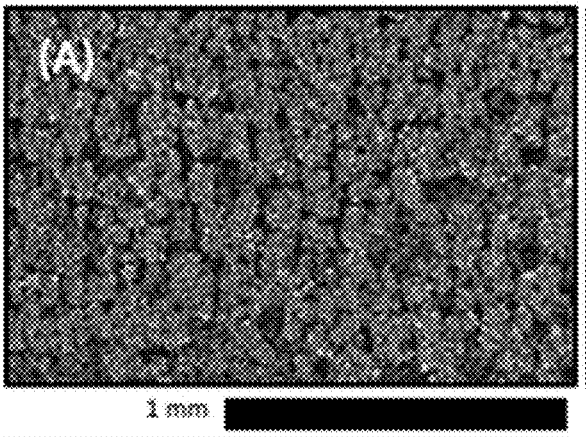
FIG. 19B
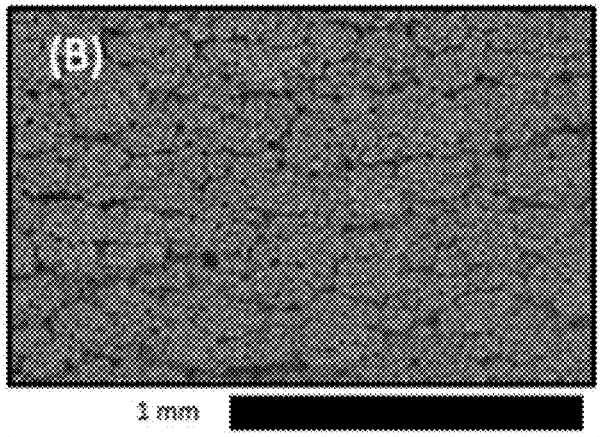
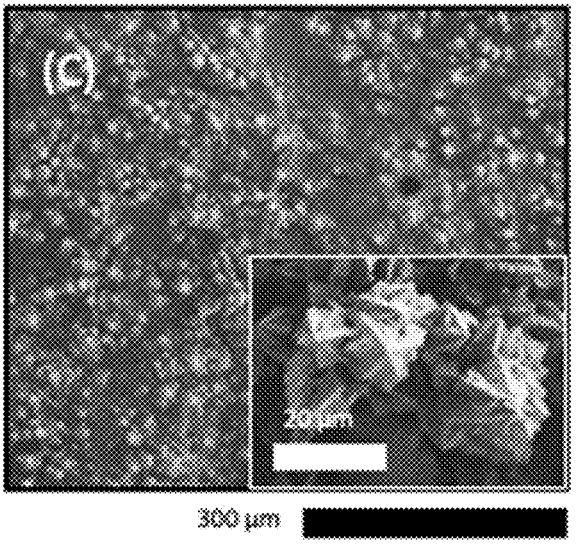
FIG. 19C
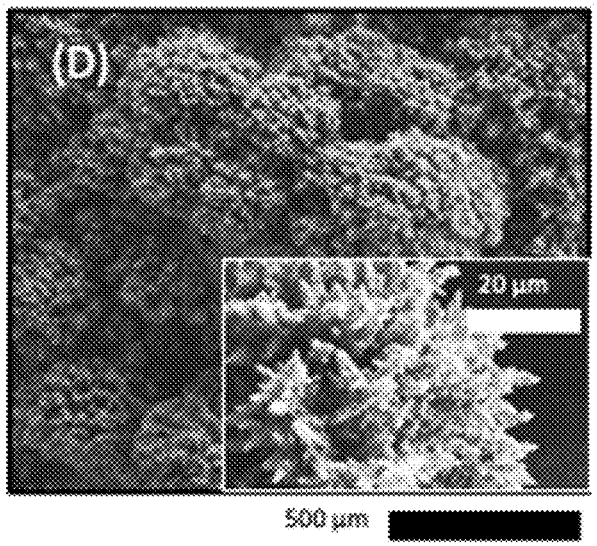
FIG. 19D

ELECTROCHEMICAL CELL AND PROCESS FOR PRODUCING METAL AND CHLORINE GAS

CROSS-REFERENCE TO RELATED APPLICATION

This application claims the benefit of the earlier filing date of U.S. Provisional Application No. 63/349,953, filed Jun. 7, 2022, which is incorporated by reference in its entirety herein.

FIELD

This disclosure concerns an electrochemical cell and a process for producing metal and chlorine gas from a metal ore and a metal chloride.

BACKGROUND

Iron and steel production accounts for ~8% of global emissions contributing to climate change. Carbon-capture costs can be avoided if the thermochemical reduction of iron ore—which consumes coal and natural gas, producing carbon emissions—is replaced with direct electrochemical reduction, particularly with electricity sourced from renewable resources. The direct reduction of iron metal from ore using zero-emissions electricity is a potentially scalable approach to avoid "difficult to decarbonize" sources of emissions. High temperature electrochemical steel production has been proposed, but capital costs for such processes have historically been incompatible with the production of tonnage metals at <$500/t (the incumbent sale price of steel used for construction). Thus, there is a need for an environmentally-friendly process that is more cost-effective.

SUMMARY

Electrochemical cells and electrowinning processes for producing metal and chlorine from metal ore and a metal chloride are disclosed. The cells and processes also co-produce a metal hydroxide.

An embodiment of the disclosed electrochemical cell for producing metal and chlorine from metal ore and a metal chloride includes a cathode, an anode, and a separator. In some embodiments, the cathode comprises low-carbon steel, iron, graphite, vitreous carbon, copper, or titanium, and the anode comprises an oxide coating comprising Ru, Pt, Ir, or any combination thereof, on a conducting substrate such as titanium. The separator may comprise a porous composite or a cation-selective membrane.

In any of the foregoing or following embodiments, the electrochemical cell may further include a gas collecting means for collecting gas generated at the anode. In any of the foregoing or following embodiments, the electrochemical cell may further include a magnet operable to be passed over a surface of the cathode. The electrochemical cell may also include a voltage source electrically connected to the cathode and the anode.

In any of the foregoing or following embodiments, the electrochemical cell may further include a catholyte and an anolyte. The catholyte may include (i) water, (ii) a metal hydroxide comprising Q, where Q is an alkali metal, an alkaline earth metal, or a combination thereof, and (iii) suspended metal ore particles comprising $M_xO_y$ where M is a metal and x and y are integers. The anolyte may include water and a metal chloride comprising Q.

In one implementation, a cell stack includes a number n of electrochemical cells as disclosed herein, a cathode electrical connector connecting cathodes of each of the electrochemical cells in parallel, and an anode electrical connector connecting anodes of each of the electrochemical cells in parallel. In an independent implementation, a cell stack includes (i) a number n of electrochemical cells as disclosed herein and arranged in series, (ii) a number n−1 of conductive bipolar plates, a conductive bipolar plate positioned between each adjacent pair of electrochemical cells, (iii) a cathode electrical connector connected to a cathode of a first electrochemical cell in the series, and (iv) an anode electrical connector connected to an anode of a last electrochemical cell in the series.

An electrowinning process for producing metal and chlorine may include (a) providing an electrochemical cell as disclosed herein and a voltage source electrically connected to the cathode and the anode, (b) providing a catholyte comprising (i) water, (ii) a metal hydroxide comprising Q, where Q is an alkali metal, an alkaline earth metal, or a combination thereof, and (iii) suspended metal ore particles comprising $M_xO_y$ where M is a metal and x and y are integers, (c) providing an anolyte comprising water and a metal chloride comprising Q, and (d) applying a voltage across the electrochemical cell to effect reduction of the $M_xO_y$ in the catholyte to provide the metal M and oxidation of chloride ions in the anolyte to form $Cl_2$ gas. A metal hydroxide comprising Q is co-produced in the catholyte. In some embodiments, providing the electrochemical cell further comprises providing a cell stack as disclosed herein.

In any of the foregoing or following embodiments, M may be Fe, Mn, Ni, Cr, Co, Zn, or any combination thereof. In some implementations, the metal ore particles comprise $Fe_2O_3$. In any of the foregoing or following embodiments, Q may be Na, K, Li, Mg, Ca, or any combination thereof. In some implementations, Q is Na. In certain embodiments, the anolyte comprises concentrated seawater. In any of the foregoing or following embodiments, the catholyte may include from 50 g/L to 500 g/L of the suspended metal ore particles prior to applying the voltage and/or the anolyte may include from 10 wt % to 50 wt % of the metal chloride prior to applying the voltage.

In any of the foregoing or following embodiments, the process may further include continuously or periodically removing $Cl_2$ generated in the anolyte and periodically removing at least a portion of the metal M from the cathode. In some embodiments, the process further includes periodically adding a quantity of the metal ore particles to the catholyte and/or periodically adding a quantity of the metal chloride to the anolyte. When the metal ore particles are obtained from a metal ore feedstock further comprising aluminates and/or silicates, the process may further include leaching at least a portion of the aluminates and/or silicates from the metal ore feedstock to provide the metal ore particles.

The foregoing and other objects, features, and advantages of the disclosure will become more apparent from the following detailed description, which proceeds with reference to the accompanying figures.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIG. 17A is a polarization curve recorded after a 30 min break-in period representing steady-state operation of the cell; FIG. 17B shows powder x-ray diffraction of reagent $\alpha$-$Fe_2O_3$ (upper tracing) and the reduced Fe product (lower tracing) after 30 min of electrolysis at 100 mA $cm^{-2}$, with simulated diffraction peaks along the x-axis for $\alpha$-Fe (single line at ~45 degrees) and $\alpha$-$Fe_2O_3$; FIGS. 17C and 17D show SEM images of the Fe surface after 30 min of electrolysis at 100 mA $cm^{-2}$ (FIG. 17C) and 300 mA $cm^{-2}$ (FIG. 17D); both inset scale bars represent 20 μm.

FIG. 18 is an SEM image showing nanoparticles and nanosheets observed on a deposited Fe surface.

FIGS. 19A-19D are top-down images of the surface morphology of Fe films as a function of the applied current density J. FIGS. 19A and 19B are optical plan view images of an Fe surface after 30 min of electrolysis at J=100 mA $cm^{-2}$ (FIG. 19A) and J=300 mA $cm^{-2}$ (FIG. 19B); FIGS. 19C and 19D are plan view SEM images of the Fe surface after 30 min of electrolysis at J=100 mA $cm^{-2}$ (FIG. 19C) and J=300 mA $cm^{-2}$ (FIG. 19D) (inset images were collected at increased magnification of the same surface).

FIG. 20A shows the relationship between $\eta_{Fe}$ and J for Fe plated; FIG. 20B shows the relationship between $\eta_{Cl2}$ and J for $RuO_x$ anodes, evaluated in the batch cell with 5.7 mol $kg^{-1}$ NaCl (pH=2) in both the anolyte and catholyte; FIG. 20C shows the relationship between $\eta_{Fe}$ and $SiO_2$ content in a representative ore mixture containing 0-8 wt % $SiO_2$ with the remainder $Fe_2O_3$ (the total amount of solids fed to the reactor was kept constant at wt %). $\eta_{Fe}$ was measured in an identical cell to FIG. 20A with the J=100 mA $cm^{-2}$; and FIG. 20D shows the polarization behavior of the batch cell in the presence of $SiO_2$ at 0 wt %, 1 wt %, and 8 wt % (solids basis).

FIG. 21A shows the polarization response of the cell after 30 min electrolysis at J=75 mA $cm^{-2}$; FIG. 21B shows the voltage performance and $\eta_{Fe}$ of the chlor-iron cell (two separate trials) at a constant J=75 mA $cm^{-2}$.

FIG. 23A shows the steady-state polarization behavior of the chlor-iron cell; FIG. 23B shows cell voltage vs. time for a constant-current electrolysis at 100 mA $cm^{-2}$ for 4 h with periodic measurements of $\eta_{Cl2}$ and an average $\eta_{Fe}$ assessed at the end of electrolysis; FIGS. 23C-23E are images of a cleaved cross-section (FIG. 23C), a focused-ion-beam cross-section (FIG. 23D), and a top-down image (FIG. 23E) of the film produced in FIG. 23B).

FIG. 24A is an SEM image of a particle analyzed via energy dispersive X-ray spectroscopy (EDX); FIG. 24B is a raw EDX spectrum used to calculate elemental composition of the particle.

DETAILED DESCRIPTION

Embodiments of an electrochemical cell and a method of using the electrochemical cell are disclosed. Certain embodiments of the electrochemical cell and process provide direct reduction of metal ore to metal along with co-production of chlorine gas from a concentrated chloride solution (e.g., concentrated seawater). Embodiments of the electrochemical cell and process further co-produce a metal hydroxide.

Figure 1A:
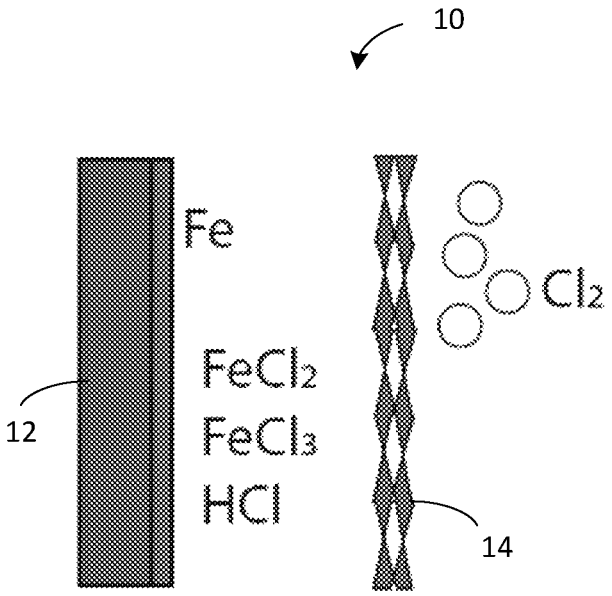
FIGS. 1A and 1B are schematic diagrams illustrating an acidic iron process (FIG. 1A) and an alkaline iron process (FIG. 1B).

Previous processes, acidic and alkaline, have disadvantages compared to the embodiments of the disclosed process. An exemplary acidic iron process is shown in FIG. 1A. An acidified solution containing dissolved iron (e.g., a waste stream from a chemical process) in HCl is placed in a cell 10 including a cathode 12 and an anode 14. The cathode 12 may be, e.g., graphite. The anode 14 may be, e.g., titanium mesh. Iron is deposited at the cathode 12 and $Cl_2$ gas is produced at the anode 14. When starting with iron ore, the process requires dissolving the iron ore with HCl and may further include reducing $Fe^{3+}$ to $Fe^{2+}$ to prevent corrosion of iron metal during plating. The dissolution step is costly and the presence of both $Fe^{3+}$ and $Fe^{2+}$ leads to parasitic currents at both electrodes that reduce the process efficiency. Parasitic currents involve the partial reduction of a dissolved metal species at the cathode:

$$M^{z+}+ne^{-}\rightarrow M^{(z-n)+}$$

The reverse reaction occurs at the anode:

$$M^{(z-n)+}\rightarrow M^{z+}+ne^{-}$$

Figure 1B:
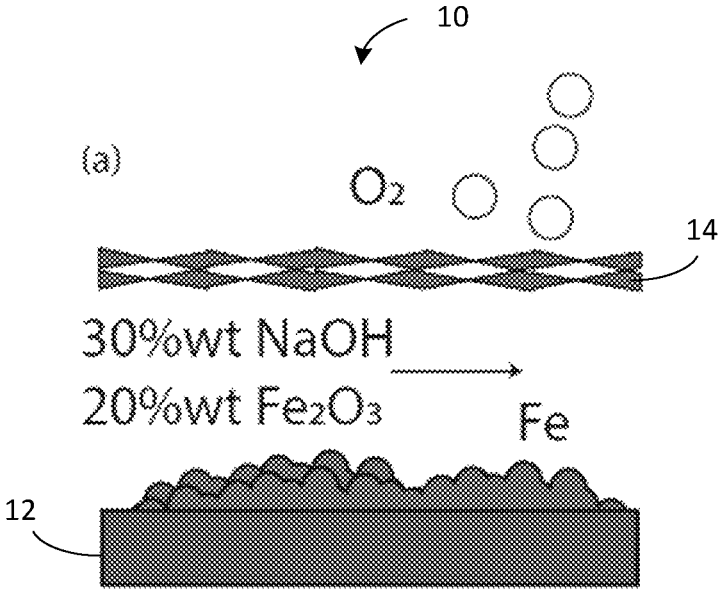

An exemplary alkaline iron process is shown in FIG. 1B. An alkaline solution containing iron ore particles ($Fe_2O_3$) and NaOH is placed in a cell 10 including a cathode 12 and an anode 14. Iron is deposited at the cathode 12 and $O_2$ gas is produced at the anode 14. The alkaline iron process poses two major problems, particularly for scaled-up processes: (1) the oxygen-rich environment at the anode 14 can mix with trace hydrogen gas leading to an explosive gas environment; and/or (2) the price per ton of oxygen gas is so low that the process margins are entirely dependent on the sale price of the iron.

I. Definitions

The following explanations of terms and abbreviations are provided to better describe the present disclosure and to guide those of ordinary skill in the art in the practice of the present disclosure. As used herein, "comprising" means "including" and the singular forms "a" or "an" or "the" include plural references unless the context clearly dictates otherwise. The term "or" refers to a single element of stated alternative elements or a combination of two or more elements, unless the context clearly indicates otherwise.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the following detailed description and the claims.

The disclosure of numerical ranges should be understood as referring to each discrete point within the range, inclusive of endpoints, unless otherwise noted. Unless otherwise indicated, all numbers expressing quantities of components, percentages, temperatures, times, and so forth, as used in the specification or claims are to be understood as being modified by the term "about." Accordingly, unless otherwise implicitly or explicitly indicated, or unless the context is properly understood by a person of ordinary skill in the art to have a more definitive construction, the numerical parameters set forth are approximations that may depend on the desired properties sought and/or limits of detection under standard test conditions/methods as known to those of ordinary skill in the art. When directly and explicitly distinguishing embodiments from discussed prior art, the embodiment numbers are not approximates unless the word "about" is recited.

Anode: An electrode through which electric charge flows into a polarized electrical device.

Bipolar plate: A plate that provides an electrical connection between two adjacent electrochemical cells, particularly between an anode compartment of one electrochemical cell and a cathode compartment of an adjacent electrochemical cell. The bipolar plate conducts current between the adjacent cells.

Cathode: An electrode through which electric charge flows out of a polarized electrical device.

Cation-selective: The term "cation-selective" refers to a material that allows cations to pass through the material, but inhibits the movement of anions through the material.

Cell: As used herein, a cell refers to an electrochemical device in which a chemical reaction may be induced by an electric current. A cell stack is an electrochemical device including two or more cells.

Composite: A solid material composed of two or more constituent materials having different physical and/or chemical characteristics that, when combined, produce a material in which each substance retains its identity while contributing desirable properties to the whole. By "retains its identity" is meant that the individual materials remain separate and distinct within the composite structure. A composite is not a solid solution or a simple physical mixture of the constituent materials. In other words, each particle of the composite includes regions or domains of the two or more constituent materials.

Current efficiency: As used herein, the current efficiency refers to the fraction, or percentage, of current that drives a desired chemical reaction, for example the current that produces a metal from a corresponding metal oxide, with the remaining current participating in side reactions.

Electrical connector: A conductive connecting device between a voltage source and an electrode. In some implementations, the electrical connector is a wire or filament.

Electrolyte: A substance containing free ions that behaves as an electrically conductive medium. An electrolyte in contact with the anode may be referred to as an anolyte, and an electrolyte in contact with the cathode may be referred to as a catholyte.

Electrowinning: Recovery of metals from solutions by electrolysis. Also used to refer to electrodeposition of metal from an ore.

Low-carbon steel: Steel containing up to 0.30 wt % carbon.

Separator: A separator is a porous sheet or film placed between the anode and cathode. It prevents physical contact between the anode and cathode and the mixing of gases while facilitating ionic transport.

Sparingly soluble: Requiring at least 1000 g of solvent to dissolve 1 g of solute; a solubility less than 1 g/1000 mL.

Vitreous (glassy) carbon: A non-graphitized and non-graphitizable carbon (cannot be converted into crystalline graphite). The chemical structure is made of sp2-bonded carbon atoms. Vitreous carbon is impermeable, resistant to chemical attack, and has a relatively low density (~1.5 g/cm$^3$ with isolated closed pores).

II. Electrochemical Cells and Cell Stacks

Embodiments of electrochemical cells and cell stacks for use in an electrowinning process are disclosed. In some embodiments, the process is used to co-produce metal and chlorine gas from a catholyte comprising a metal ore and an anolyte comprising a chloride salt. The net reaction is:

$$M_xO_{y(s)}+yH_2O+2yCl^{-}\rightarrow 2yOH^{-}+xM_{(s)}+yCl_{2(g)}$$

where M is a metal and x and y are integers.

Electrochemical Cells

Figure 2A:
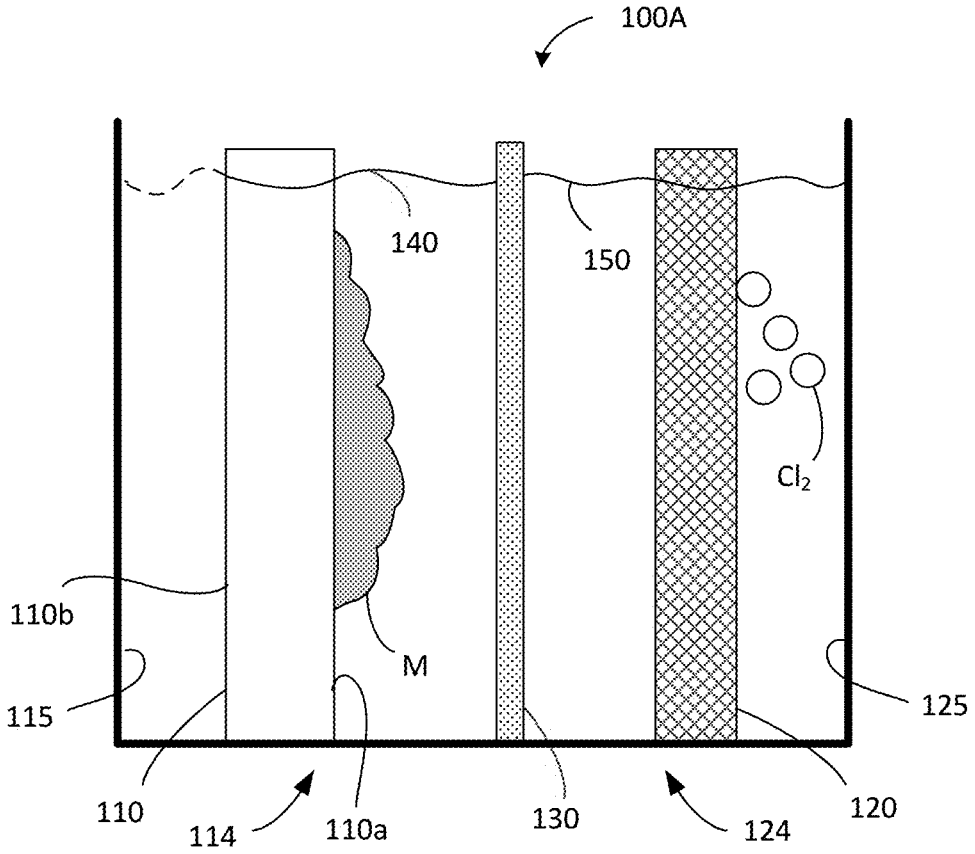
FIGS. 2A-2C are schematic diagrams of an exemplary electrochemical cell (FIG. 2A), a cathode and anode, each comprising an active material and a current collector (FIG. 2B), and another exemplary electrochemical cell with several additional components (FIG. 2C).
Figure 2B:
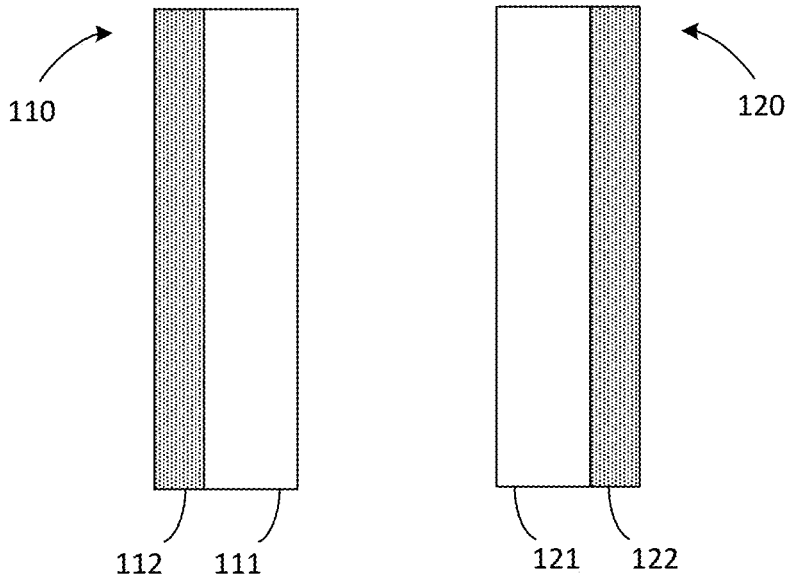
Figure 2C:
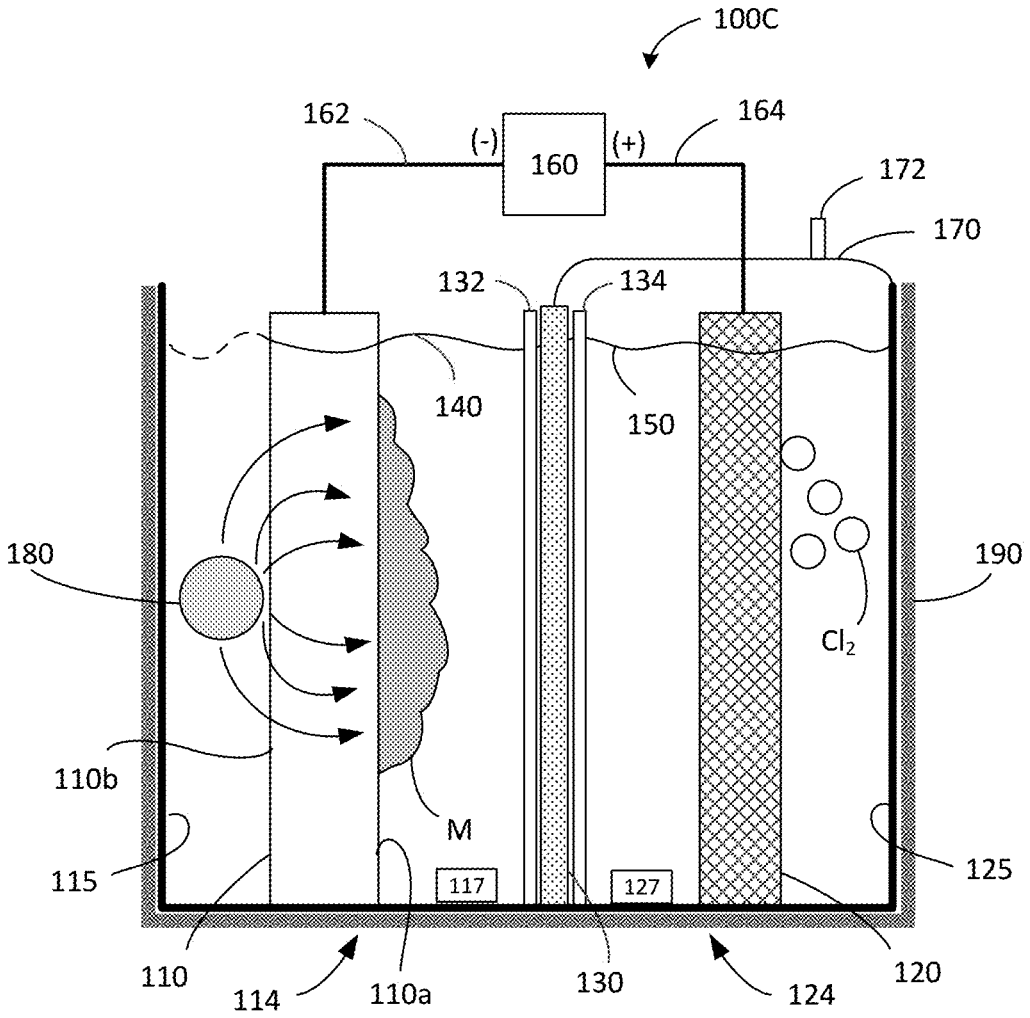

FIGS. 2A-2C illustrates exemplary embodiments of an electrochemical cell 100A, 100C (FIGS. 2A, 2C). The electrochemical cell 100A (FIG. 2A) includes the primary components of the cell. The electrochemical cell 100C of FIG. 2C includes additional components, which are present in some aspects of the cell. It is to be understood that each additional component shown in FIG. 2C individually may be present or absent in various aspects of the electrochemical cell.

The electrochemical cell 100A, 100C comprises a cathode 110, an anode 120, and a separator 130 between the cathode 110 and the anode 120. In use, a catholyte 140 is present in the cell 100 and is in fluid contact with the cathode 110 and the separator 130, and an anolyte 150 is present in the cell 100 and is in fluid contact with the anode 120 and the separator 130. In some implementations, the separator 130 is mounted between two spacers 132, 134 (FIG. 2C), which permit fluid contact of the separator 130 with the catholyte 140 and anolyte 150. In some arrangements, the cathode 110 is positioned within a cathode compartment 114, which may be defined by a cathode compartment wall 115 and the separator 130, and/or the anode 120 is positioned within an anode compartment 124, which may be defined by an anode compartment wall 125 and the separator 130. In other arrangements, such as when the cathode is a plate cathode, the cathode compartment 114 may be defined by the cathode 110, the separator 130, and portions of the wall 115 extending between the cathode 110 and the separator 130. Similarly when the anode is a plate anode, the anode compartment 124 may be defined by the anode 120, the separator 130, and portions of the wall 125 extending between the anode 120 and the separator 130. In certain embodiments, e.g., as shown in FIG. 2C, the electrochemical cell 100C further comprises a voltage source 160 electrically connected to the cathode 110 by a cathode electrical connector 162 and to the anode 120 by an anode electrical connector 164. Electrical current is supplied to the cathode 110 and anode 120, and an ionic current across the catholyte 140, separator 130, and anolyte 150 completes the circuit.

In any of the foregoing or following embodiments, the cathode 110 may comprise low-carbon steel, iron, copper, graphite, vitreous carbon, titanium, or any combination thereof. In some embodiments, the cathode has an active cathode area (i.e., the surface area of face 110*a* of the cathode in contact with the catholyte) of from 0.2 $m^2$ to 10 $m^2$, such as from 0.2 $m^2$ to $m^2$, 0.2 $m^2$ to 3 $m^2$, 0.2 $m^2$ to 2.5 $m^2$, 0.2 $m^2$ to 2 $m^2$, 0.25 $m^2$ to 2 $m^2$, 1 $m^2$ to 10 $m^2$, 0.5 $m^2$ to $m^2$, or 0.5 $m^2$ to 5 $m^2$. In some implementations, the cathode 110 comprises a cathode active material 111 and a cathode current collector 112, as shown in FIG. 2B. Suitable cathode current collector materials include, but are not limited to, iron, carbon, copper, and titanium. The cathode active material 111 and current collector 112 may be the same material or different materials.

In any of the foregoing or following embodiments, the anode 120 may comprise a metal oxide-coated substrate or current collector, as shown in FIG. 2B. In some implementations, the substrate or current collector is conductive. In some embodiments, the metal oxide coating 121 comprises oxides of Ru, Pt, Ir, or any combination thereof. In some implementations, the anode substrate or current collector 122 comprises a titanium plate, mesh, or foil. In certain embodiments, a mesh substrate facilitates rapid removal of gas ($Cl_2$) bubbles from the anode surface. In some implementations, the anode is a mixed metal oxide anode comprising a mixture of Ru, Pt, and Ir oxides on a titanium substrate. One exemplary anode is the DSA® electrode (Industrie De Nora S.p.A., Milan, Italy). The anode of the cell may constructed from one or more sheets in electrical contact and have a total active area similar in size to the cathode active area, e.g., 0.2 $m^2$ to 10 $m^2$.

The electrochemical cell 100C may comprise a catholyte mixing means 117 and/or an anode mixing means 127 (FIG. 2C). Any suitable mixing means may be used. For example, the mixing means may be an impeller rotatably attached to a base of the cathode compartment 114 or anode compartment 124, an impeller on a rotating shaft lowered into the cathode compartment 114 or anode compartment 124, or a fluid (electrolyte, compressed air, or inert gas) pumped or recirculated below cathode compartment 114 or anode compartment 124. The mixing means may be constructed of any material that is inert to the catholyte and anolyte, and does not participate in the electrochemical reactions occurring in the electrochemical cell.

The separator 130 is permeable to alkali metal cations and/or alkaline earth metal cations. In any of the foregoing or following embodiments, the separator may be a porous composite with pore diameters between 2 and 200 nm (a diaphragm) or a cation-selective membrane.

In some embodiments, the separator 130 is a porous composite, or diaphragm, comprising a polymer and metal oxide nanoparticle. In one implementation, the porous composite comprises polysulfone and $ZrO_2$ nanoparticles. The composite may be coated onto a support substrate, such as a polyphenylene sulfide fabric. One commercially available polysulfone/$ZrO_2$ porous composite is a Zirfon® PERL separator (Agfa-Gevaert NV, Mortsel, Belgium). The Zirfon® PERL UTP 500 separator has an average pore size of 150±50 nm.

In some embodiments, the separator 130 is a cation-selective membrane. The cation-selective membrane permits passage of alkali metal cations and alkaline earth metal cations. In one implementation, the cation-selective membrane comprises fluorinated polyethylene chains with side groups comprising fluorinated sulfonic acids. One suitable commercially available separator is a Nafion™ sulfonated tetrafluoroethylene-based fluoropolymer-copolymer separator (manufactured by The Chemours Company, Wilmington, Delaware). In some implementations, the separator 130 is a bilayer membrane. Some suitable bilayer membranes include a sulfonated tetrafluoroethylene-based fluoropolymer-copolymer layer and a second layer with a higher ionic strength or higher rejection rate. Exemplary sulfonated tetrafluoroethylene-based fluoropolymer-copolymer cation-selective membranes include, but are not limited to, a Nafion™ N2030 bilayer membrane and a Nafion™ 115 membrane, available from Chemours, Wilmington, DE. In another implementation, the cation-selective membrane is a reinforced perfluorosulfonic acid (PFSA membrane), such as a polytetrafluoroethylene (PTFE) substrate (e.g., fabric)-reinforced PFSA membrane (e.g., GI-N417 membrane, available from the Fuel Cell Store, Bryan, TX). In still another implementation, the cation-selective membrane is hydrogen separator membrane, such as a mesh polyphenylene sulfide substrate (e.g., fabric) coated with a polymer and zirconium oxide, e.g., a ZIRFON PERL UTP-500 membrane (available from Agfa, Mortsel, Belgium).

In any of the foregoing or following embodiments, the electrochemical cell 100C may further comprise gas collecting means for collecting gas (e.g., chlorine gas) generated at the anode 120. In some embodiments, the gas collecting means 170 (FIG. 2C) covers the anode compartment 124 and does not cover the cathode compartment 114. The gas collecting means 170 may comprise an outlet 172 to facilitate collection of chlorine. Chlorine gas may be collected continuously or periodically through the outlet 172 while the electrochemical cell 100C is operating. In some embodiments, e.g., as shown in FIG. 2C, the gas collecting means 170 only extends over the anode compartment 124 and does not extend over the cathode compartment 114. In any of the foregoing or following embodiments, the gas collecting means 170 may be a gas envelope comprising a rigid or substantially rigid cover that extends from a wall 125 of the anode compartment 124 to the separator 130, the cover further including an outlet 172. Desirably, the gas envelope or cover is made of a material that does not react with evolved chlorine gas and is impermeable to chlorine gas. Suitable materials for the gas envelope or cover include, but are not limited to fiber-reinforced polyvinyl chloride, nickel, and/or nickel-coated carbon steel.

During operation of the electrochemical cell 100A, 100C, a metal M is deposited onto a surface 110*a* of the cathode 110. In some embodiments, the metal M is magnetic. In some implementations, a removable cathode 110 may periodically be removed from the electrochemical cell 100 and the deposited metal M removed from the cathode surface 110*a* by any suitable means (e.g., scraping, peeling, or rinsing).

In any of the foregoing or following embodiments, the electrochemical cell 100C may further include a thermal insulation material 190 proximate an external surface of the cathode compartment 114, proximate an external surface of the anode compartment 124, or proximate external surfaces of the cathode compartment 114 and the anode compartment 124 (FIG. 2C). The thermal insulation material 190 may retain heat generated by the electrochemical reactions taking place in the cell 100C and/or may reduce an amount of external energy required to operate the electrochemical cell 100C at a desired temperature. In any of the foregoing or following embodiments, an external heating device (not shown) may be used to raise the temperature within the electrochemical cell to a desired operating temperature prior to using the electrochemical cell. In some embodiments, the external heating device also is used during cell operation to maintain the desired temperature when the electrochemical reactions do not generate sufficient heat to maintain the desired temperature.

In another embodiment (not shown), a single electrochemical cell may include a plurality of spatially separated cathodes in the cathode compartment and a corresponding plurality of spatially separated anodes in the anode compartment. The electrochemical cell further comprises a voltage source electrically connected to the cathodes in parallel by a cathode electrical connector and to the anodes in parallel by an anode electrical connector. Alternatively, a voltage source may be separately connected to each cathode and a corresponding anode by an individual cathode electrical connector and anode electrical connector, respectively.

In some aspects, the electrochemical cell 100C may further comprise a magnet 180 (FIG. 2C). In some implementations, the magnet 180 is a magnetic drawbar or a magnetic rod. The magnet 180 is movable along a length of the cathode 110 to facilitate periodic collection of magnetic metal M deposited onto the cathode surface 110*a*. In some implementations, as shown in FIG. 2C, the magnet 180 is passed over an opposing surface 110*b* of the cathode 110. As the magnet 180 is moved along the surface 110*b*, at least some of the metal M moves along the surface 110*a* following movement of the magnet 180. As the magnet 180 is lifted out of the electrochemical cell 100, at least a portion of the metal M is transferred from the surface 110*a* to the magnet 180 and removed from the electrochemical cell 100 with the magnet 180. The magnet 180 may be moved by any suitable means, including manual movement by an operator or automatic movement controlled by an external controller device. In one embodiment, when the cathode 110 is constructed from a magnetic material (e.g., the cathode is iron-based), the electrochemical cell 100 does not include a magnet 180. In an independent embodiment, when the metal ore in the catholyte 140 is magnetic, the electrochemical cell 100A, 100C does not include a magnet 180.

In some implementations, the magnet 180 is immersed in the catholyte 140. In other implementations, the magnet 180 is placed such that the magnet 180 is not immersed in the catholyte 140.

Figure 3A:
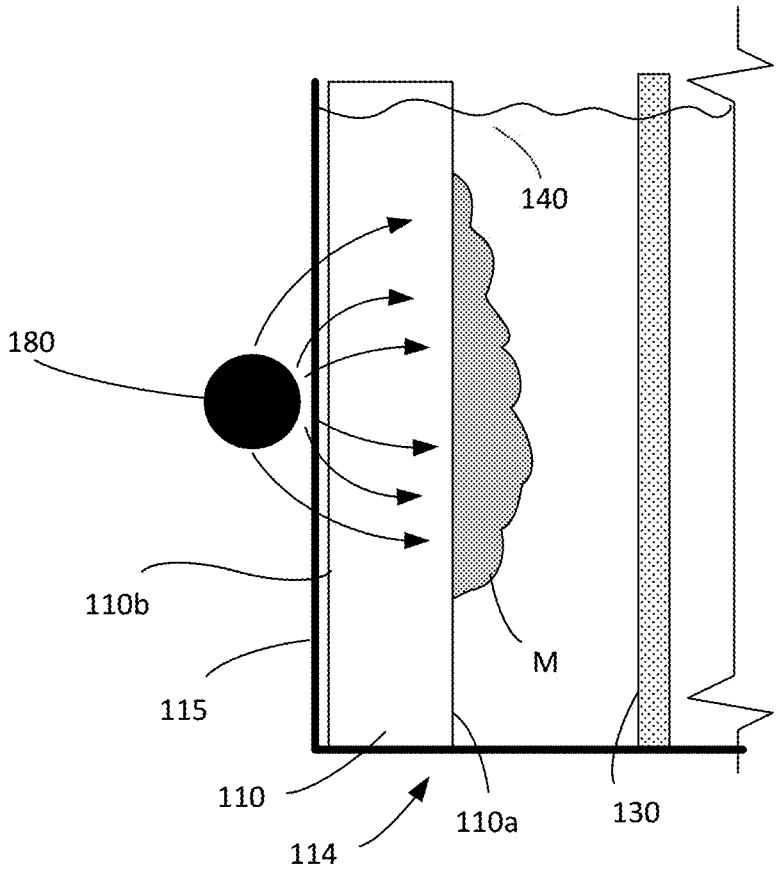
FIGS. 3A-3C are partial schematic diagrams of exemplary electrochemical cells with an external magnet (FIG. 3A), a magnet on a back side of the cathode (FIG. 3B), or a magnet between the cathode and the separator (FIG. 3C).
Figure 3B:
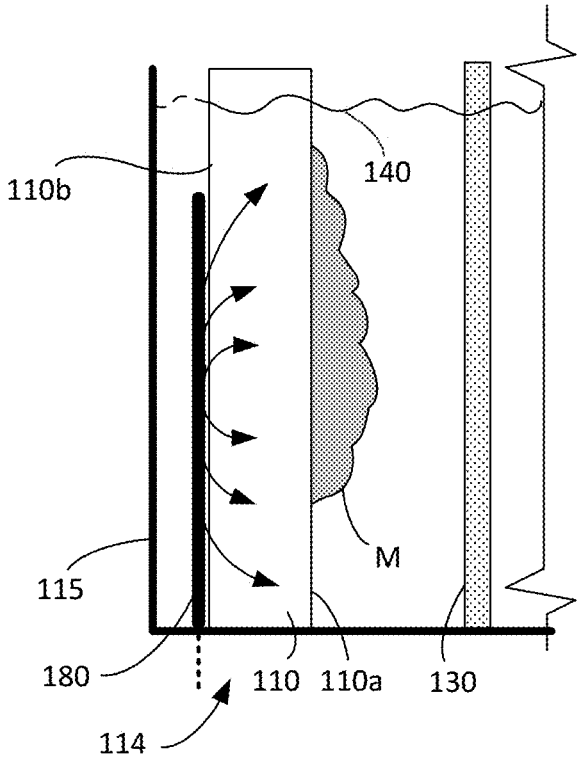

In one embodiment, the cathode 110 is a plate (for example, a graphite plate) such that cathode surface 110*b* defines an external wall surface of the cathode compartment 114 and the magnet 180 is placed adjacent surface 110*b* (e.g., as shown in FIG. 2C) such that the magnet 180 is between the cathode surface 110*b* and the wall 115. In an independent embodiment (FIG. 3A), the cathode 110 is disposed proximate an internal surface of a cathode compartment wall 115 with the magnet 180 proximate an external surface of the cathode compartment wall 115, the wall 115 permitting magnetic interaction between the magnet 180 and deposited metal M. In another independent embodiment (FIG. 3B), the magnet 180 may be a magnetic rod placed proximate a surface 110*b* of the cathode 110. In such arrangements, the cathode surface 110*b* may comprise a recessed groove (not shown) to receive the magnetic rod, thereby facilitating minimal spacing between the cathode surface 110*b* and the wall 115. In the arrangement of FIG. 3B, the magnet 180 may nor may not be immersed in the catholyte 140; for instance, if the cathode 110 is a plate cathode that extends across a width of the cell 100, the magnet 180 may not be immersed in the catholyte 140. In still another independent embodiment (FIG. 3C), the magnet 180 may be a magnetic drawbar or a magnetic rod placed between the cathode 110 and the separator 130.

Figure 3C:
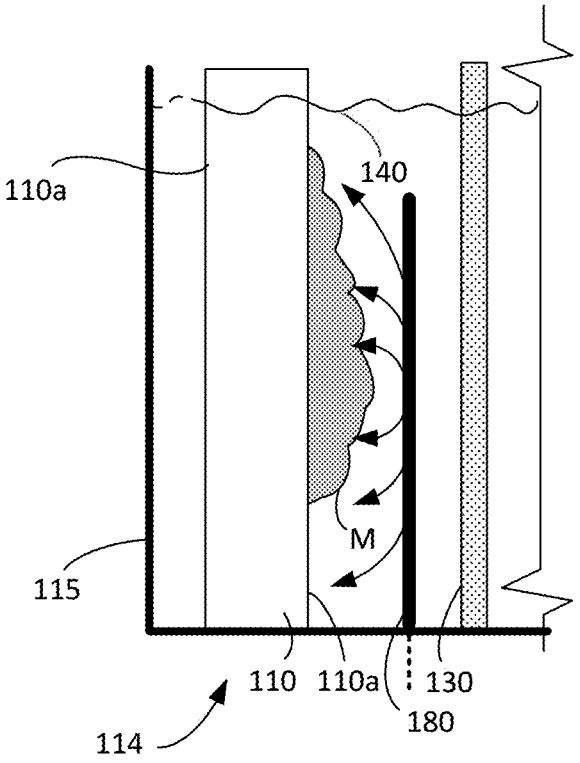

In any of the foregoing embodiments, the magnet 180 may be actuated and manipulated externally to collect metal deposited on the cathode 110. In some implementations, a portion (dashed line) of the magnetic rod 180 may extend through a lower wall of the cathode compartment 114 to facilitate manipulation of the magnetic rod (FIGS. 3B, 3C).

Electrochemical Cell Stacks

Figure 4:
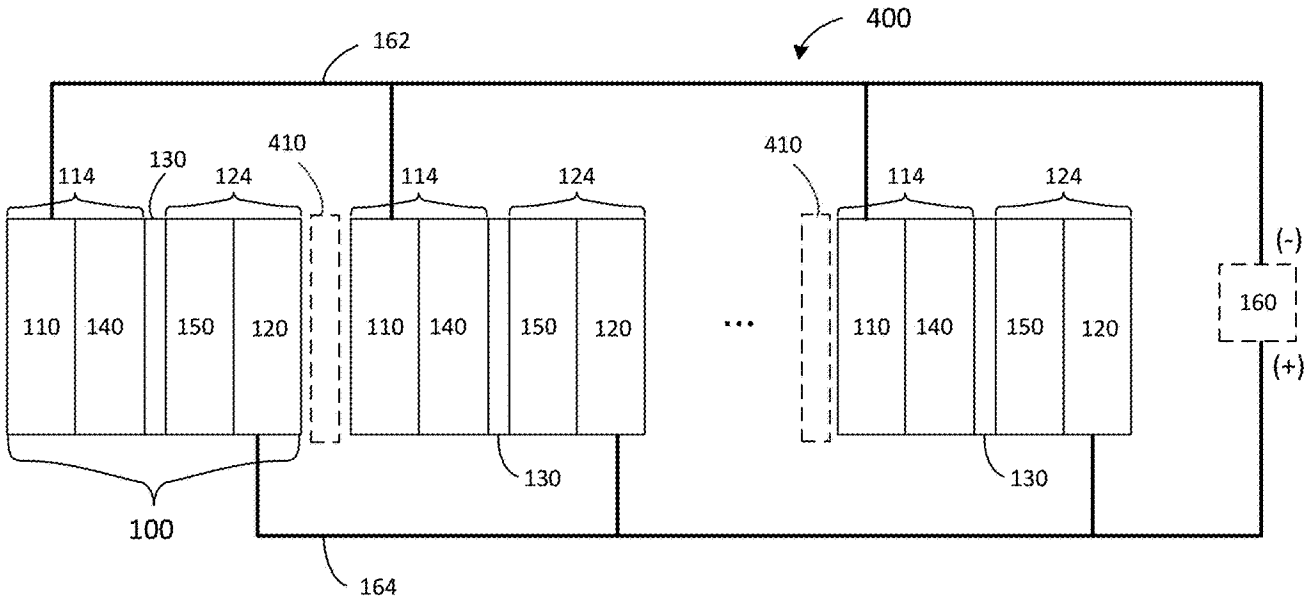
FIG. 4 is a schematic diagram of an exemplary cell stack comprising a plurality of electrochemical cells.

In some embodiments, a plurality of electrochemical cells is assembled to form a cell stack. FIG. 4 is a schematic block diagram illustrating one exemplary embodiment of a cell stack 400. The cell stack 400 includes a number n of electrochemical cells 100 as disclosed herein. The number n is 2 or more. In some embodiments, the number n is from 2 to 100, such as from 5-100, 10-100, 25-100, or 25-75. The cells 100 are arranged in parallel. The cell stack 300 further includes a cathode electrical connector 162 connecting each of the cathodes 110 in parallel, and an anode electrical connector 164 connecting each of the anodes 120 in parallel. The cell stack 400 may further include a voltage source 160 connected to the cathode electrical connector 162 and the anode electrical connector 164. The cells 100 of the stack 400 may be spatially separated as shown in FIG. 4. Alternatively, an electrically nonconductive plate or membrane 410 may be placed between each pair of adjacent cells 100. Exemplary materials for the nonconductive plate or membrane include, but are not limited to, metals (e.g., stainless steel) with an insulating elastomeric coating, non-conducting composites, and non-conducting polymers suitable for use at the stack operating temperature.

Figure 5:
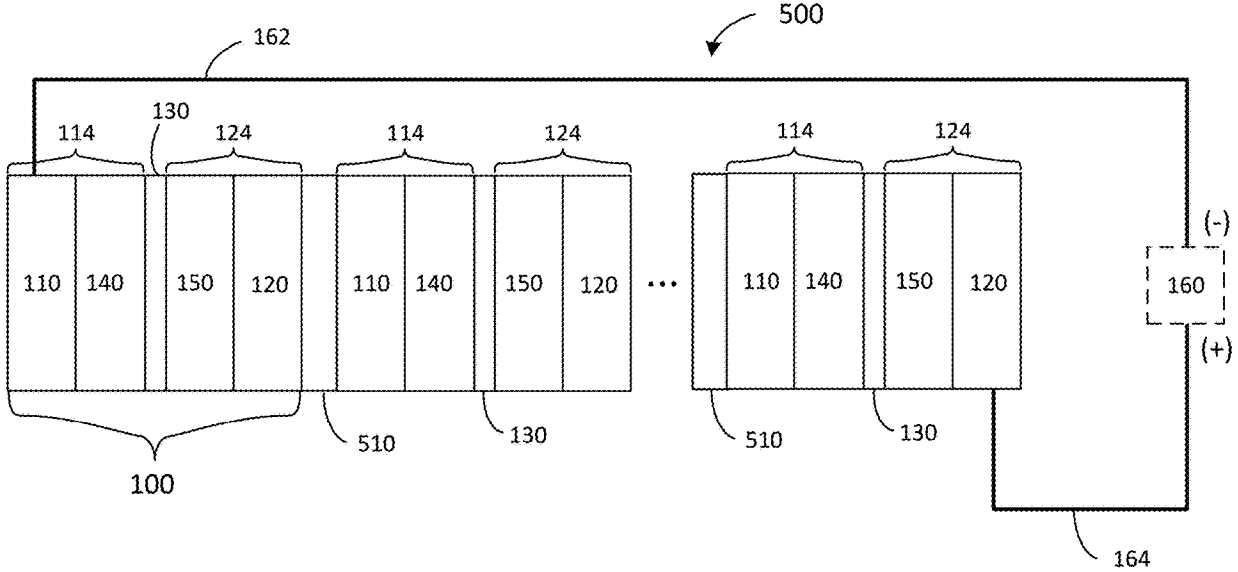
FIG. 5 is a schematic diagram of another exemplary cell stack comprising a plurality of electrochemical cells.

FIG. 5 is a schematic block diagram illustrating another exemplary embodiment of a cell stack 500. The cell stack 500 includes a number n of electrochemical cells 100 as disclosed herein. The number n is 2 or more. In some embodiments, the number n is from 2 to 100, such as from 5-75, 5-50, 10-50, or 20-50. The cells 100 are arranged in series. The stack 500 further comprises a number n−1 of conductive bipolar plates 510. A conductive bipolar plate 510 is positioned between each adjacent pair of electrochemical cells 100. Suitable materials for the conductive bipolar plate include, but are not limited to, nickel, nickel-plated steel, conductive carbon (e.g. vitreous carbon or graphite), and conductive composites. In one embodiment, all of the conductive bipolar plates have the same composition. In another embodiment, the conductive bipolar plates may be constructed of different materials. In some implementations, the conductive bipolar plate 510 comprises graphite. In such implementations, the cathode 110 and anode 120 may comprise metal foils on either side of the thermally and electrically conductive graphite, with the anode further comprising an oxide coating as described herein. The cell stack 500 may further include a voltage source 160, a cathode electrical connector 162, and an anode electrical connector 164. The cathode electrical connector 162 is connected to a cathode 110 of the first electrochemical cell 100 in the series. The anode electrical connector 164 is connected to an anode 120 of the last (nth) electrochemical cell 100 in the series. The cell stack 500 may further include a voltage source 160 connected to the cathode electrical connector 162 and the anode electrical connector 164. The cathode electrical connector 162 and the anode electrical connector 164 may be high-voltage connectors.

In the cell stack 400, 500, each cathode may have the same composition, or at least one cell may include a cathode 110 of a different composition. In the cell stack 400, 500, each anode 120 may have the same composition, or at least one cell may include an anode of a different composition. In the cell stack 400, 500, each separator 130 may have the same composition, or at least one cell may include a separator of a different composition. When prepared for use, the cell stack 400, 500 includes a catholyte 140 in each electrochemical cell 100 (e.g., in the cathode compartment 114) and an anolyte 150 in each electrochemical cell 100 (e.g., in the anode compartment 124). In the cell stack 400, 500, each catholyte may have the same composition, or at least one cell may include a catholyte of a different composition. In the cell stack 400, 500, each anolyte may have the same composition, or at least one cell may include an anolyte of a different composition.

In the cell stack 400, 500, each electrochemical cell 100 may include a gas collecting means (not shown), as previously described, to collect gas generated at the anode. Alternatively, a single gas collecting means may be configured to collect chlorine gas from each of the plurality of electrochemical cells 100. In such an arrangement, the single gas collecting means may be subdivided so that each anode compartment 124 is covered by the gas collecting means while the cathode compartments 114 are not covered by the gas collecting means.

In some embodiments, the cell stack 400, 500 further comprises one or more magnets (not shown) to facilitate collecting deposited metal from the cathodes 110. In one implementation, a magnet is inserted in each electrochemical cell 100. The magnet 180 may be, for example, a magnetic rod (e.g., a polyethylene coated magnet) inserted adjacent a surface of the cathode 110 (e.g., adjacent surface 110*b* as shown in FIG. 3B). In one arrangement (not shown), the cathode surface 110*b* may include a recessed groove to receive the inserted magnetic rod. Alternatively, the magnet 180 may be inserted between the cathode 110 and the separator 130 (FIG. 3C). The magnetic rod may be inserted from the top of the cell 100 or through a bottom wall of the cell 100 (e.g., as shown by the dashed portion in FIGS. 3B, 3C). The magnet is actuated and manipulated externally to collect metal deposited on the cathode 110. In another implementation, one or more small permanent magnets may be placed in each cathode compartment 114 and externally manipulated to collect deposited metal. In still another implementation, the cathodes 110 are removable and deposited metal may be removed from the cathode surface by any suitable means (e.g., scraping, peeling, or rinsing).

When prepared for use, the electrochemical cell 100 includes a catholyte 140 and an anolyte 150. The catholyte comprises (i) water, (ii) a metal hydroxide comprising Q, where Q is an alkali metal, an alkaline earth metal, or a combination thereof, and (iii) suspended metal ore particles comprising $M_xO_y$, where M is a metal and x and y are integers. The anolyte comprises water and a metal chloride comprising Q. Further details of the catholyte and anolyte are discussed below.

III. Process for Producing Metal and Chlorine Gas

The disclosed electrochemical cells and cell stacks may be used in an electrowinning process for producing metal and chlorine. Advantageously, the metal M and $Cl_2$ gas are both commodity products that are useful in manufacturing processes. Additionally, a metal hydroxide is co-produced. The metal hydroxide is also useful in manufacturing processes. For example, the metal hydroxide may be used to leach silicates and/or aluminates from metal ores, as well as in other processes, such as carbon capture.

Figure 6:
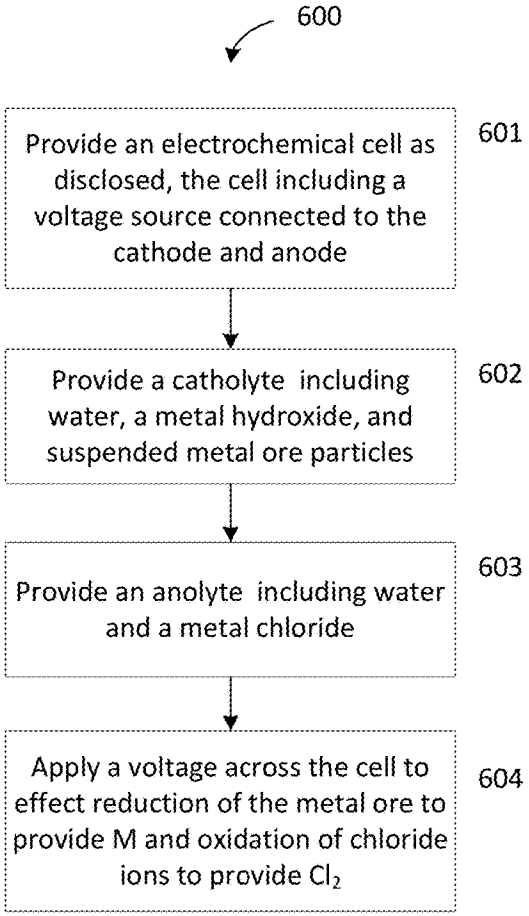
FIG. 6 is a flowchart illustrating one exemplary electrowinning process as disclosed herein.

As shown in FIG. 6, an exemplary electrowinning process 600 includes providing an electrochemical cell as disclosed herein, the electrochemical cell further including a voltage source electrically connected to the cathode and the anode (step 601); providing a catholyte within the cathode compartment, the catholyte comprising (i) water, (ii) a metal hydroxide comprising Q, where Q is an alkali metal, an alkaline earth metal, or a combination thereof, and (iii) suspended metal ore particles comprising $M_xO_y$ where M is a metal and x and y are integers (step 602); providing an anolyte within the anode compartment, the anolyte comprising water and a metal chloride comprising Q (step 603); and applying a voltage across the electrochemical cell to effect reduction of the metal ore ($M_xO_y$) particles in the cathode compartment to provide the metal M and oxidation of chloride ions in the anode compartment to form $Cl_2$ gas (step 604). In some embodiments, the reduced metal M is deposited as a dense film onto a surface of the cathode. The deposited dense film may be a free-standing film. In certain implementations, M is periodically collected as a film, a porous deposit, or fine powder.

The overall reactions at the cathode and anode are as follows:

$$\text{cathode: } M_xO_{y(s)}+yH_2O+2y\,e^-\rightarrow 2yOH^-+xM(s)$$

$$\text{anode: } 2Cl^-\rightarrow Cl_{2(g)}+2e^-$$

The net reaction is:

$$M_xO_{y(s)}+yH_2O+2yCl^-\rightarrow 2yOH^-+xM_{(s)}+yCl_{2(g)}$$

In the above reactions, Q cations provide the balancing charges. Because the separator is permeable to Q cations, as hydroxide anions and $Cl_2$ gas are produced, Q cations pass from the anolyte through the separator and into the catholyte to maintain the charge balance. In some embodiments, a small amount of $O_2$ also is generated at the anode, which contributes to an acidic environment at the anode surface and suppresses further generation of $O_2$. The acidic environment facilitates maintaining the $Cl_2$ in gaseous form in the anode compartment.

The catholyte comprises (i) water, (ii) a metal hydroxide comprising Q, where Q is an alkali metal, an alkaline earth metal, or a combination thereof, and (iii) suspended metal ore particles comprising $M_xO_y$ where M is a metal and x and y are integers. In some embodiments, $M_xO_y$ comprises a multivalent metal oxide. The integers x and y are determined by the charge on M and, in combination, provide a neutral metal oxide compound. The metal oxide may be sparingly soluble (e.g., a solubility of less than 1 g/1000 mL) in the alkaline environment.

In some implementations, the metal ore has a maximum silicate (e.g., $SiO_2$) content of 5 wt %, such as a silicate content of 0 wt % to 4 wt %, 0 wt % to 3 wt %, or 0 wt % to 2 wt %. In some implementations, the metal ore has a maximum aluminate content of 5 wt %, such as an aluminate content of 0 wt % to 4 wt %, 0 wt % to 3 wt %, or 0 wt % to 2 wt %.

In any of the foregoing or following embodiments, M may be Fe, Mn, Ni, Cr, Co, Zn, or any combination thereof. In certain implementations, M is Fe. When M is Fe, the process may be referred to as the "Chlor-Iron" process. When M is Fe, $M_xO_y$ comprises $Fe_2O_3$, FeO, $Fe_3O_4$ ($Fe^{2+}Fe^{3+}{}_2O_4$), or any combination thereof. In some examples, the metal ore is hematite, and $M_xO_y$ comprises $Fe_2O_3$. In any of the foregoing or following embodiments, the suspended metal ore particles may have an average size within a range of from 10 μm to 1 mm, such as from 10 μm to 750 μm, or 10 μm to 500 μm. In any of the foregoing or following embodiments, prior to applying the voltage, the catholyte may comprise from 50 g/L to 500 g/L (or 5 wt % to 50 wt %) of the suspended metal ore particles. In some embodiments, the initial concentration of the suspended ore particles is from 100 g/L to 400 g/L, 100 g/L to 300 g/L, or 150 g/L to 250 g/L, or wt % to 400 wt %, 10 wt % to 30 wt %, or 15 wt % to 25 wt %. In certain examples, the initial suspended ore particle concentration is 20 wt % or 200 g/L.

In any of the foregoing or following embodiments, Q may be Na, K, Li, Mg, Ca, or any combination thereof. In some implementations, Q is Na and the metal hydroxide is NaOH. Prior to applying the voltage, the catholyte may comprise from 10 wt % to 50 wt % of the metal hydroxide. In some embodiments, the initial metal hydroxide concentration is 10 wt % to wt %, 20 wt % to 40 wt %, or 25 wt % to 35 wt %. In certain examples, the initial metal hydroxide concentration is 30 wt %. As shown in the cathode reaction above, additional metal hydroxide is produced as the electrochemical cell is operated.

The anolyte comprises water and a metal chloride comprising Q, where Q is as previously defined. In any of the foregoing or following embodiments, Q may be the same in both the catholyte and the anolyte. Thus, if the catholyte comprises NaOH, then the anolyte may comprise NaCl. Similarly if the catholyte comprises KOH, then the anolyte may comprise KCl. In some implementations, Q is Na and the metal chloride comprises NaCl. Prior to applying the voltage, the anolyte may comprise from 10 wt % to 50 wt % of the metal chloride. In some embodiments, the initial metal chloride concentration is 10 wt % to 40 wt %, 20 wt % to wt %, or 25 wt % to 35 wt %. In certain examples, the initial metal chloride concentration is wt %. In some implementations, the metal chloride is provided by seawater. The seawater may be concentrated (e.g., via evaporation) to provide an initial metal chloride concentration of from 10 wt % to 50 wt %, such as an initial metal chloride concentration of 10 wt % to 40 wt %, wt % to 40 wt %, or 25 wt % to 35 wt %.

In some implementations, the catholyte comprises water, NaOH, and suspended metal ore particles comprising $Fe_2O_3$, and the anolyte comprises water and NaCl. In one non-limiting example, the catholyte comprises 30 wt % NaOH and 20 wt % $Fe_2O_3$ in water, and the anolyte comprises 30 wt % NaCl in water.

During operation of the electrochemical cell, a locally alkaline environment (e.g., pH>14) is maintained at the cathode and a locally acid chloride environment (pH<6) is maintained at the anode during operation of the cell; the separator facilitates maintenance of the alkaline and acidic environments. Conversion and/or dissolution of metal species (e.g., $M_xO_y$) occurs locally at the cathode which minimizes or prevents undesirable crossover of M cations through the separator. Additionally, crossover of M cations through the separator may be minimal or non-existent because the reduction of $M_xO_y$ occurs without producing significant quantities of free M cations. For example, when $M_xO_y$ is $Fe_2O_3$, most or all of the iron in the hematite is directly reduced to Fe; any free unreduced $Fe^{3+}$ cations are coordinated with hydroxide anions to form $Fe(OH)_4^-$ anions, which do not pass through the separator.

Figure 7:
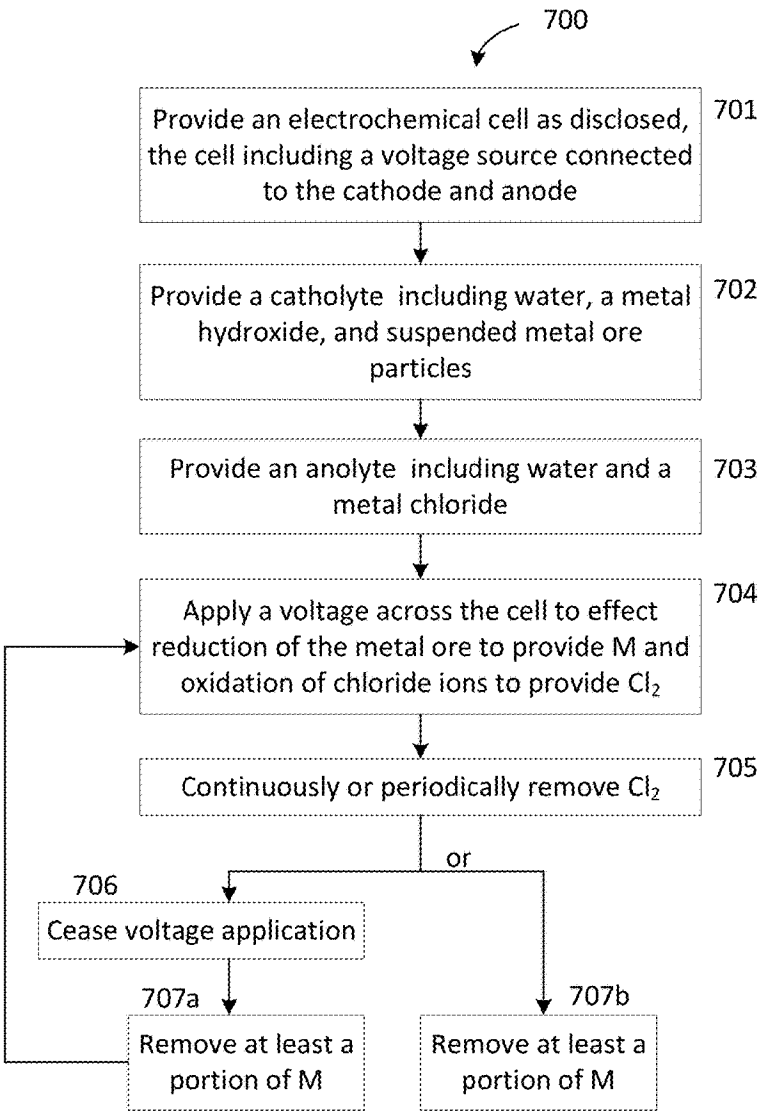
FIG. 7 is a flowchart illustrating another exemplary embodiment of the electrowinning process as disclosed herein.

FIG. 7 illustrates another exemplary electrowinning process 700. Steps 701-704 are the same as those described for FIG. 6, steps 601-604, respectively. In the exemplary embodiment of FIG. 7, the electrowinning process further comprises continuously or periodically removing $Cl_2$ from the anode compartment (step 705). Thus, steps 704 and 705 are performed simultaneously. In other words, continuous or periodic removal of $Cl_2$ occurs while applying the voltage. The process of FIG. 7 also comprises periodic removal of at least a portion of the deposited metal M. In some embodiments, from 5-100% of the deposited M is removed from the cathode surface, such as from 10-100%, 25-100%, or 25-75%. In one embodiment, voltage application is ceased (step 706), and at least a portion of the deposited metal M is removed from the cathode compartment (step 707*a*). Following removal of metal M, the voltage is reapplied (step 704). In an independent embodiment, periodic removal of metal M is performed while applying the voltage (step 707*b*, performed while step 704 is being performed). The metal M may be periodically removed by any suitable means. In some embodiments, the cathode is removable and deposited metal M is removed from the cathode surface by periodically removing the cathode from the cathode compartment and then scraping, peeling, or rinsing the cathode surface to remove the deposited metal M; in such arrangements, voltage application is ceased (step 706) prior to removing the cathode from the cell. In some implementations, the M is deposited onto the cathode as a dense film. When the metal is dense, it may be removed from the cathode as a single, free-standing film. In certain embodiments, the metal M is magnetic and is deposited onto a surface of the cathode. In some aspects, the deposited magnetic metal is removed as described above. In other aspects, periodically removing at least a portion of the magnetic metal M comprises (i) passing a magnet over a surface of the cathode or over an opposing surface of the cathode, and (ii) removing the magnet from the cathode compartment, whereby the metal M deposited onto the surface of the cathode is transferred to the magnet as the magnet is removed. In such arrangements, metal removal may occur with or without ceasing the voltage application. In certain implementations, the magnet is a magnetic drawbar or a magnetic rod.

Figure 8:
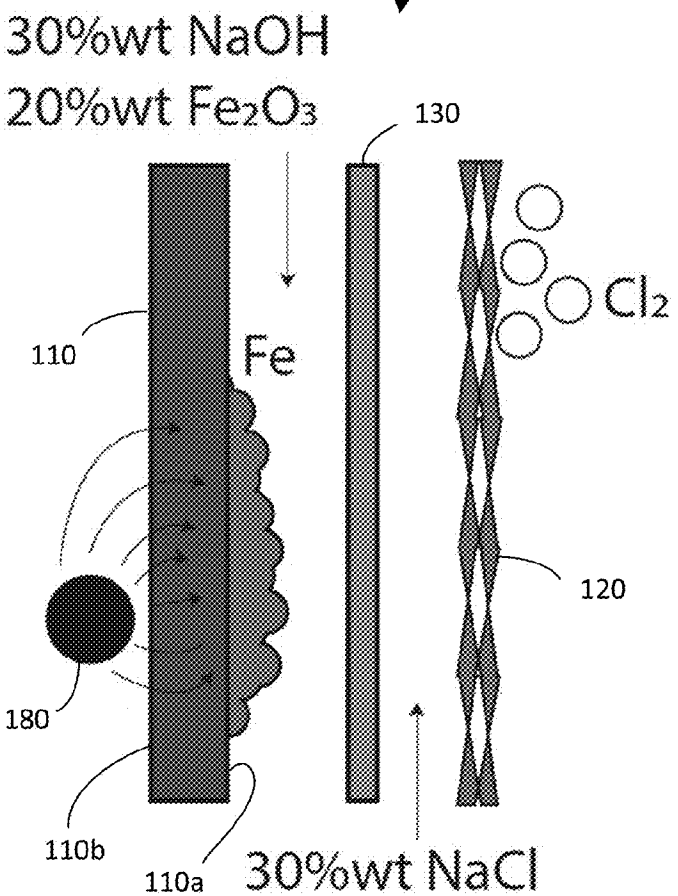
FIG. 8 is a schematic diagram illustrating aspects of an electrochemical cell used in one exemplary embodiment of an electrowinning process as disclosed herein.

FIG. 8 is a schematic diagram illustrating one exemplary embodiment of the electrowinning process of FIGS. 6 and 7, wherein the metal ore comprises $Fe_2O_3$, the metal hydroxide comprises NaOH, and the metal chloride comprises NaCl. An electrochemical cell 100 comprises, in part, a cathode 110, and anode 120, and a separator 130. An aqueous catholyte comprising 30 wt % NaOH and 20 wt % $Fe_2O_3$ particles is in contact with the cathode 110, and an aqueous anolyte comprising 30 wt % NaCl is in contact with the anode 120. Upon application of a voltage across the electrochemical cell 100, the iron in $Fe_2O_3$ is reduced and deposited as Fe metal on a surface 110*a* of the cathode 110. Concurrently, chloride ions are oxidized at the anode 120 to form $Cl_2$ gas. In some aspects, a removable cathode 110 may periodically be removed from the electrochemical cell 100 and the deposited metal M removed from the cathode surface 110*a* by any suitable means (e.g., manual scraping, peeling, or rinsing).

In some implementations, a magnet 180 is passed over an opposing surface 110*b* of the cathode to remove Fe from the surface 110*a*. With reference to FIGS. 2C, 3A, 3B, and 8, as the magnet 180 passes over the cathode surface 110*b*, the deposited magnetic metal M on the cathode surface 110*a* moves along the surface 110*a* as the magnet moves along the opposing surface 110*b*. As the magnet 180 is withdrawn from the electrochemical cell 100, at least a portion of the metal M is transferred from the cathode surface 110*a* to a surface of the magnet 180 and removed from the electrochemical cell 100. With reference to FIG. 3C, as the magnet 180 passes over the cathode surface 110*a*, deposited metal M on the cathode surface 110*a* is transferred to the magnet 180. In any of the foregoing or following embodiments, the magnet 180 may be manually passed over the cathode surface, or the process may be automated. In some embodiments, from 5-100% of the deposited M is removed from the cathode surface, such as from 10-100%, 25-100%, or 25-75%. When the magnet 180 is immersed in the catholyte (e.g., as shown in FIG. 3C), metal M fines that are not deposited onto the cathode surface 110*a* and are free in the catholyte 140 also may be removed by the magnet 180. Advantageously, when the metal ore is non-magnetic (e.g., hematite), the metal ore particles remain in the catholyte 140.

$Cl_2$ may be continuously or periodically removed from the anode compartment 120 by removing accumulated $Cl_2$ gas from the gas envelope 170 via the outlet 172 (FIG. 2C). Advantageously, when the gas envelope 170 is configured to extend only over the anode compartment 120, the metal M may be removed from the cathode compartment 110 without opening the anode compartment 120.

As the electrowinning process is performed, the concentration of metal ore particles in the catholyte and the concentration of metal chloride in the anolyte decreases. Thus, in some embodiments, the catholyte and anolyte are periodically replenished to restore desired concentrations of metal ore particles and/or metal chloride. Additionally, in certain implementations, such as when the separator is a porous composite, some hydroxide anions may cross through the separator and into the anolyte, thereby reducing the hydroxide concentration in the catholyte and increasing a pH of the anolyte. In such implementations, the method may further include replenishing metal hydroxide in the catholyte and/or adding dilute HCl to the anolyte to maintain a desirable pH.

Figure 9:
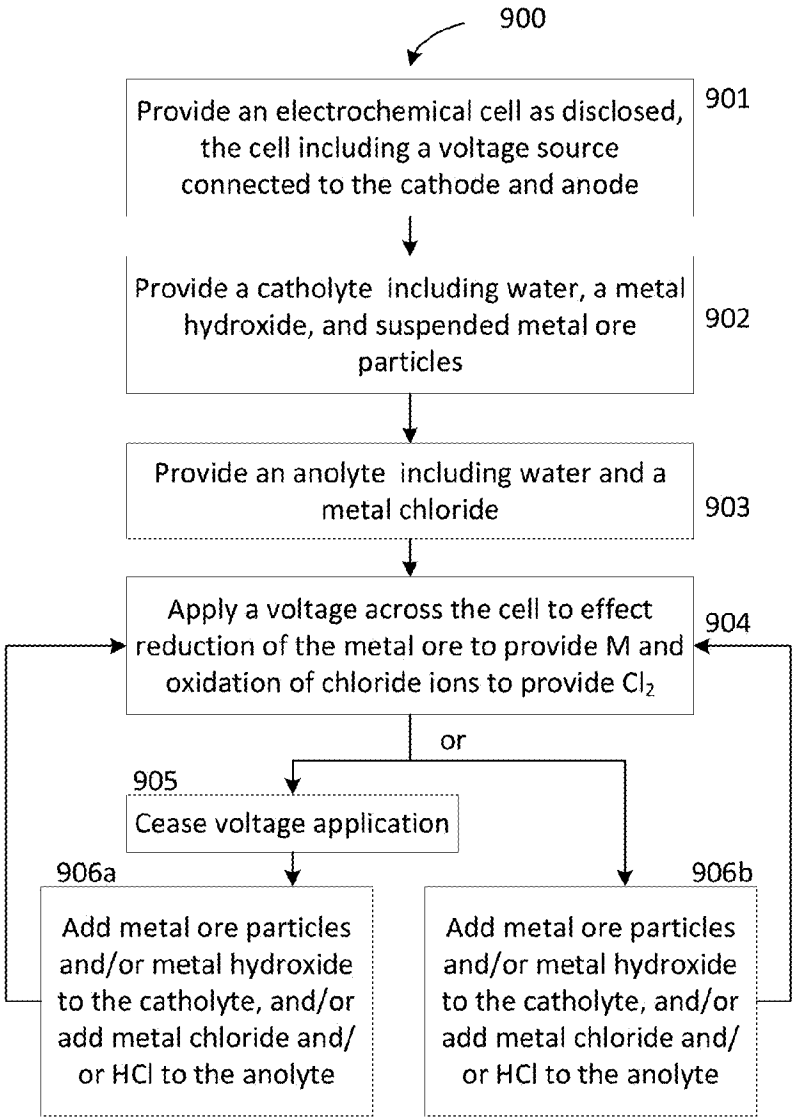
FIG. 9 is a flowchart illustrating yet another exemplary embodiment of the electrowinning process as disclosed herein.

FIG. 9 illustrates an exemplary electrowinning process 800 in which the catholyte and anolyte are periodically replenished. Steps 901-904 are the same as those described for FIG. 6, steps 601-604, respectively. In the exemplary embodiment of FIG. 9, the electrowinning process further comprises (i) periodically adding a quantity of the metal ore particles and/or a quantity of metal hydroxide to the catholyte; or (ii) periodically adding a quantity of the metal chloride and/or dilute HCl (e.g., 0.1-6 M HCl) to the anolyte (to maintain a slightly acid pH at the anode); or (iii) both (i) and (ii). In some embodiments, the electrowinning process is a batch process and voltage application ceases (step 905) while the catholyte and/or anolyte is replenished (step 906*a*). Voltage application (step 904) may resume after replenishment (step 906*a*) is complete. In an independent embodiment, the electrowinning process is a continuous process and catholyte and/or anolyte replenishment (step 906*b*) is performed while the voltage continues to be applied (step 904). In such implementations, the electrochemical cell may be a flow cell. In some embodiments, adding the quantity of the metal ore particles comprising adding a suspension comprising the quantity of the metal ore particles to the catholyte. In some implementations, adding a quantity of the metal chloride comprises adding a solution or a suspension comprising the quantity of the metal chloride to the anolyte. In some implementations, periodically replenishing the catholyte with additional metal ore particles and periodically replenishing the anolyte with additional metal chloride allows the process to continue without completely replacing the catholyte and anolyte.

When the metal ore particle concentration decreases, the metal hydroxide concentration in the catholyte concomitantly increases, particularly when the separator is a cation-selective membrane that does not allow passage of hydroxide anions. Replenishing the catholyte by adding a suspension of metal ore particles also dilutes the metal hydroxide concentration. When the separator is a cation-selective membrane, the dilution may restore a desired concentration of the metal hydroxide. However, if the separator allows crossover of hydroxide and the metal hydroxide concentration is insufficient after dilution, a quantity of metal hydroxide may be added as a solid, a suspension, or a solution, and may be added together with or separately from the metal ore particles to restore the desired hydroxide concentration (steps 906*a*, 906*b*). If dilute HCl is added to the anolyte to compensate for any hydroxide crossover, the dilute HCl may be added together with or separately from the metal chloride (steps 906*a*, 906*b*). It is understood by a person of ordinary skill in the art that, in any of the foregoing or following embodiments, the process may further include removing a volume of the spent catholyte and/or anolyte from the electrochemical cell before replenishing the electrolytes so that the cell does not overflow.

Figure 10:
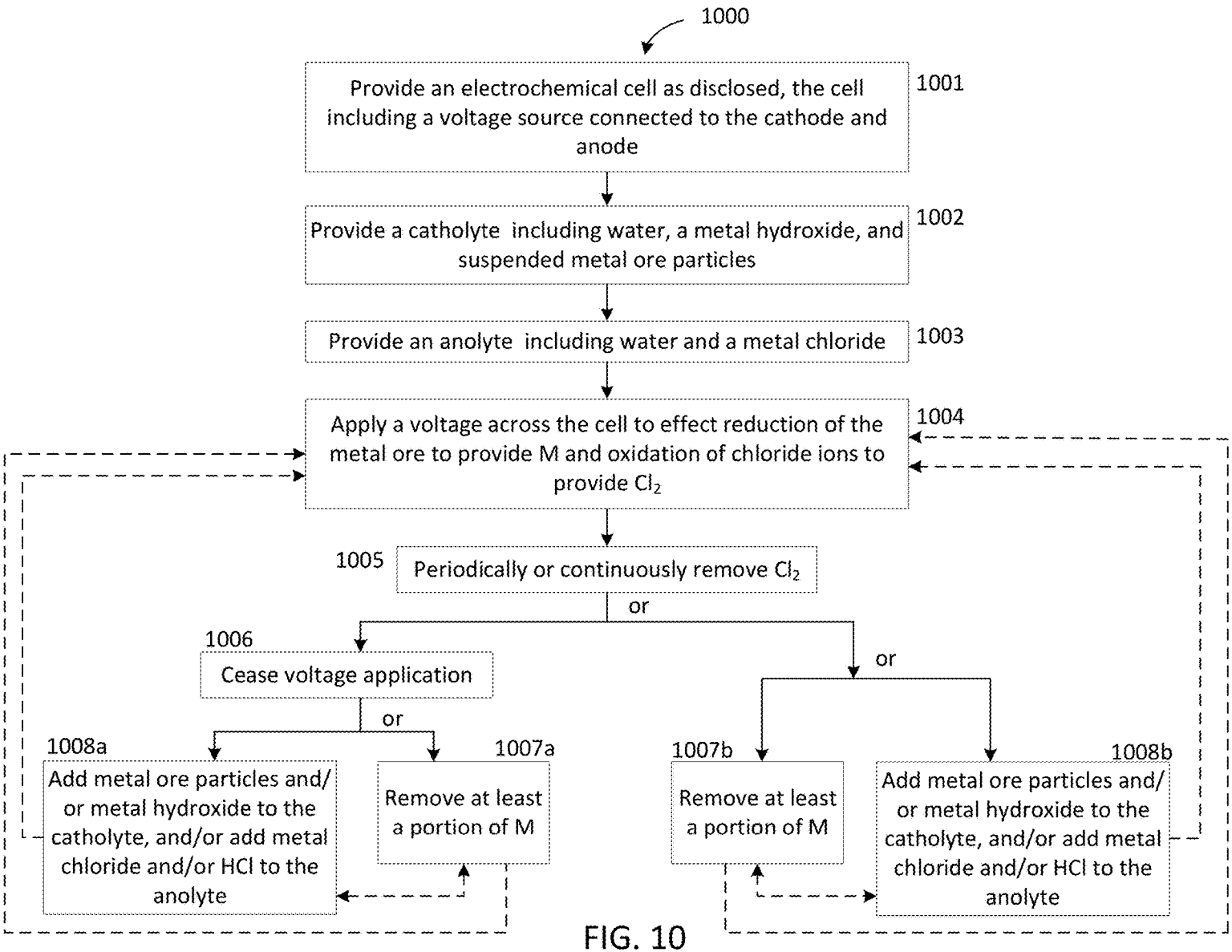
FIG. 10 is a flowchart illustrating still another exemplary embodiment of the electrowinning process as disclosed herein.

FIG. 10 illustrates an exemplary electrowinning process including both product removal and electrolyte replenishment. Steps 1001-1004 are the same as those described for FIG. 6, steps 601-604, respectively. Steps 1005, 1006, 1007*a*, and 1007*b* are the same as those described for FIG. 7, steps 705, 706, 707*a*, and 707*b*, respectively. Steps 1006, 1008*a* and 1008*b* are the same as those described for FIG. 9, steps 905, 906*a* and 906*b*, respectively.

The steps of product removal and electrolyte replenishment may be performed at the same frequency or with different frequencies. For example, removal of metal M may occur more frequently than electrolyte replenishment, or electrolyte replenishment may occur more frequently than removal of metal M. Addition of metal hydroxide and/or dilute HCl may occur at the same frequency or less frequently than addition of metal ore particles and/or metal chloride.

In one embodiment, step 1006 is followed by step 1007*a* and then by step 1008*a*, after which the process returns to step 1004. In an independent embodiment, step 1006 is followed by step 1008*a* and then by step 1007*a*, after which the process returns to step 1004. In another independent embodiment, only one of steps 1007*a* and 1008*a* is performed before returning to step 1004. In yet another independent embodiment, steps 1007*b* and 1008*b* are performed substantially consecutively in any order while the voltage continues to be applied. In still another embodiment, only one of steps 1007*b* and 1008*b* is performed and an interval of time passes before the other of steps 1007*b* and 1008*b* is performed; the voltage is applied throughout the process. When multiple cycles of steps 1004-1008 are performed, the selection and sequence of steps 1006/1007*a*/1008*a* or 1007*b*/1008*b* may vary with each cycle.

In any of the foregoing or following embodiments, providing the electrochemical cell (steps 601, 701, 901, 1001) may further comprise providing a cell stack. In one embodiment (e.g., as illustrated in FIG. 4), the cell stack comprises a number n of the electrochemical cells, a cathode electrical connector connecting cathodes of each of the electrochemical cells in parallel, an anode electrical connector connecting anodes of each of the electrochemical cells in parallel, and a voltage source electrically connected to the cathode electrical connector and the anode electrical connector. In an independent embodiment (e.g., as illustrated in FIG. 5), the cell stack comprises a number n of the electrochemical cells, a number n−1 of conductive bipolar plates wherein one conductive bipolar plate is positioned between each adjacent pair of electrochemical cells, a cathode electrical connector connected to a cathode of a first electrochemical cell in the series, an anode electrical connector connected to an anode of a last electrochemical cell in the series, and a voltage source electrically connected to the cathode electrical connector and the anode electrical connector. In any of the foregoing or following embodiments where the process is performed with a cell stack, providing the catholyte within the cathode compartment (steps 602, 702, 902, 1002) may further comprise providing the catholyte within each cathode compartment of the cell stack. In any of the foregoing or following embodiments where the process is performed with a cell stack, providing the anolyte within the anode compartment (steps 603, 703, 903, 1003) may further comprise providing the anolyte within each anode compartment of the cell stack. As previously discussed, the catholyte and anolyte in each cathode compartment and anode compartment, respectively, may have the same composition or different compositions. In any of the foregoing or following embodiments where the process is performed with a cell stack, applying a voltage across the electrochemical cell may further comprise applying the voltage across the cell stack to effect reduction of the metal ore ($M_xO_y$) particles in each cathode compartment to provide the metal M and formation of $Cl_2$ gas in each anode compartment. If the catholyte and anolyte compositions vary from cell to cell within the stack, the deposited M may be a different metal in one or more the cells.

In any of the foregoing or following embodiments, the electrochemical cell or cell stack may be operated at a temperature of from 25° C. to 150° C., such as a temperature in a range having endpoints selected from 25° C., 30° C., 35° C., 40° C., 50° C., 60° C., 70° C., 80° C., 90° C., 100° C., 110° C., 120° C., 130° C., 140° C., or 150° C., wherein the range is inclusive of the endpoints. In some embodiments, the electrochemical cell or cell stack is operated of from 50° C. to 70° C., 70° C. to 90° C., 90° C. to 120° C., or 100° C. to 150° C. The concentrated catholyte and anolyte enable the electrochemical cell to operate at temperatures above the boiling point of water. However, the temperature may be maintained at temperatures lower than 150° C. (e.g., 25° C. to 100° C.) to prolong the lifetime of various cell components (e.g., the anode and/or separator) that may fail at more elevated temperatures.

In any of the foregoing or following embodiments, the voltage applied may be from 2 V to 5 V, such as 2 V to 4 V or 2.5 V to 4 V (3500 to 5500 kWh tonne iron), for a single cell. In any of the foregoing or following embodiments, the electrochemical cell or cell stack may be operated at a current density of from 20 mA $cm^{-2}$ to 500 A $cm^{-2}$, such as a current density range having endpoints selected from 20 mA $cm^{-2}$, 50 mA $cm^{-2}$, 100 mA $cm^{-2}$, 250 mA $cm^{-2}$, 500 mA $cm^{-2}$, 1 A $cm^{-2}$, 5 A $cm^{-2}$, 10 A $cm^{-2}$, 25 A $cm^{-2}$, 50 A $cm^{-2}$, 100 A $cm^{-2}$, 200 A $cm^{-2}$, 300 A $cm^{-2}$, 400 A $cm^{-2}$, or 500 A $cm^{-2}$, wherein the range is inclusive of the endpoints. In some embodiments, the current density is 20 mA $cm^{-2}$ to 400 A $cm^{-2}$, 20 mA $cm^{-2}$ to 300 A $cm^{-2}$, 50 mA $cm^{-2}$ to 300 A $cm^{-2}$, or 50 mA $cm^{-2}$ to 200 A $cm^{-2}$. The current density may depend, at least in part, on the applied voltage, the electrochemical cell temperature, the concentrations of the metal ore particles comprising $M_xO_y$ and the metal chloride, or any combination thereof. When the device comprises a stack of cells connected in parallel (e.g., as shown in FIG. 3), the stack current is calculated as the single-cell current×the number of cells.

In any of the foregoing or following embodiments, the current efficiency toward metal ore reduction at the cathode (over side reactions, such as hydrogen evolution) may range from 60% to 95%, such as from 70% to 95%, 80% to 95%, or even 85% to 95%.

In any of the foregoing embodiments, the process may be a batch process, a continuous process, or a semi-continuous. In a continuous or semi-continuous process, product removal and/or reactant replenishment may be performed while continuing to apply the voltage across the electrochemical cell. In some aspects, use of a magnet, such as a magnetic drawbar, to collect the deposited metal M, may facilitate continuous operation of the electrochemical cell or stack. In a continuous or semi-continuous process, pumps that circulate or recirculate the catholyte may become fouled by the suspension of metal ore particles and eventually fail. In some embodiments, the process is a batch process. In the batch process, the voltage may be applied for a period of time, after which voltage application ceases, the metal M is removed from the cathode compartment ($Cl_2$ is removed continuously from the anode compartment during cell operation). The catholyte and/or anolyte may be replenished, and cell operation is resumed.

Embodiments of the disclosed processes exhibit several advantages over prior electrowinning processes. For example, the reactants may include inexpensive materials, such as iron oxide ores (e.g., hematite) and salt water brines. Although an initial quantity of metal hydroxide is needed, the net reaction ($M_xO_{y(s)}$+y $H_2O$+2y $Cl^-$→2y $OH^-$+x $M_{(s)}$+y $Cl_{2(g)}$)) produces hydroxide during the process. Advantageously, the process results in two commodity products—the metal M and $Cl_2$ gas—produced at large scale (at least 10 Mt/y within the U.S.).

In some implementations, when M is Fe and the metal ore does not include significant amounts of silicates (e.g., the metal ore includes no more than 5 wt % silicates), the electrowinning process may have a Faradaic efficiency toward iron ($\eta_{Fe}$) of at least 85% at current densities from 100 mA $cm^{-2}$ to 300 mA $cm^{-2}$. In certain aspects at current densities≤200 mA $cm^{-2}$, $\eta_{Fe}$ is >90%, such as >94%. In some implementations, the Faradaic efficiency toward $Cl_2$ ($\eta_{Cl2}$) is at least 80%, at least 85%, or at least 90%.

Reduced metal M is recovered as a solid from the cathode compartment and $Cl_2$ gas is recovered from the anolyte compartment. The co-produced hydroxide is dissolved in the catholyte. Separating the three products is straightforward since they are present as different states of matter.

In some embodiments, the recovered metal M has a purity of at least 90 wt %, at least wt %, at least 96 wt %, at least 97 wt %, or at least 98 wt %. In some aspects, the reduced metal comprises particles having an average diameter of from 5 μm to 100 μm, such as from μm to 50 μm. In other aspects, the metal is deposited as a film, such as a free-standing film. The morphology may be controlled, at least in part, by the applied current density. In one non-limiting example, a current density of 100 mA $cm^{-2}$ produced films largely free of pinholes, whereas deposition at 300 mA $cm^{-2}$ provided a product comprising multiple large pinholes. When M is Fe, the iron produced by aspects of the disclosed electrochemical cell and process has a morphology and purity suitable for use as feedstock in electric arc furnaces for steel manufacturing or production of monolithic iron electrodes, among other uses. The chlorine may be used the production of metal chloride salts, or preparing chlorine-containing compounds, as well as other utilities, such as use in bleaching processes, disinfecting processes, and water cooling systems, among others.

The hydroxide produced during the process is a third commodity product. The spent catholyte comprises a solution of metal hydroxide and water, and may further comprise residual metal ore ($M_xO_y$) particles. While the hydroxide solution may comprise impurities since the spent catholyte may include residual amounts of metal oxide or metal, the low-purity hydroxide nonetheless has multiple uses. One use is purification of metal ore, such as leaching out impurities. For example, if a metal ore comprises silicates (e.g., $SiO_2$) and/or aluminates, the metal hydroxide solution may be used to leach at least some of the silicates and/or aluminates from the metal ore. In some implementations, metal ore intended for use in the disclosed electrowinning process may be pre-leached with metal hydroxide from the spent catholyte prior to introducing the metal ore into the electrochemical cell. In another aspect, the metal hydroxide solution may be used for carbon capture by capturing and mineralizing $CO_2$, such as by capturing and mineralizing $CO_2$ from the air or ocean. In some implementations, the spent catholyte comprising metal hydroxide is used (e.g., for leaching or carbon capture) without further purification. In certain implementations, the spent catholyte may be filtered before use to remove any residual metal and/or metal particles, and/or otherwise purified.

The direct use of electricity as a reductant circumvents the need for shipping and storing intermediate reducing agents such as hydrogen and thus provides a pathway to lower plant costs. The operating temperature (room temperature to 150° C.) may be lower than in other processes, which allows use of less expensive materials for the electrodes, separators, and other components than processes operating at more extreme temperatures. The low operating temperatures are compatible with intermittent zero-emissions electricity (e.g., solar energy, wind energy). Embodiments of the disclosed process also eliminate the need to dissolve metal salts, the need to perform an initial reduction process (e.g., $Fe^{3+}$ to $Fe^{2+}$), and the need to transport and store large quantities of HCl and metal hydroxides. In traditional processes requiring metal salt dissolution, electrowinning of multivalent metals (including Fe, Ni, or Cr) can lead to parasitic currents between the anode and cathode and fouling of the separator by salt crossover is common. Parasitic currents and separator fouling may be reduced or eliminated by embodiments of the disclosed electrochemical cell and method.

IV. EXAMPLES

Example 1

Cell Preparation and Electrolysis Protocol

Anode preparation: An ink for preparing a ruthenium oxide coating was prepared by dissolving $RuCl_3$ (anhydrous) powder in 20% w/w hydrochloric acid and applying gentle heat until all the liquid had been removed. The powder that remained was resuspended in isopropyl alcohol to a concentration of approximately 2 mg/mL. This liquid (hereafter "ink") was used to applying ruthenium, Ru, to the electrode surface. Titanium was polished with micron-grade alumina polishing paper, soaked in 20% w/w hydrochloric acid for 1 min and rinsed with deionized water. The substrate was then massed. Titanium was repeatedly brushed with the ink and dried on a hotplate set to 130° C. and then annealed in an open-air furnace set to 500° C. in 10-15 minute increments with the loading of the Ru checked by changes in mass until the added mass of the coating was 4 mg.

Cathode preparation: Iron was plated onto low carbon steel substrates that polished with micron-grade alumina polishing paper and then massed prior to use as a deposition substrate.

Figure 11:
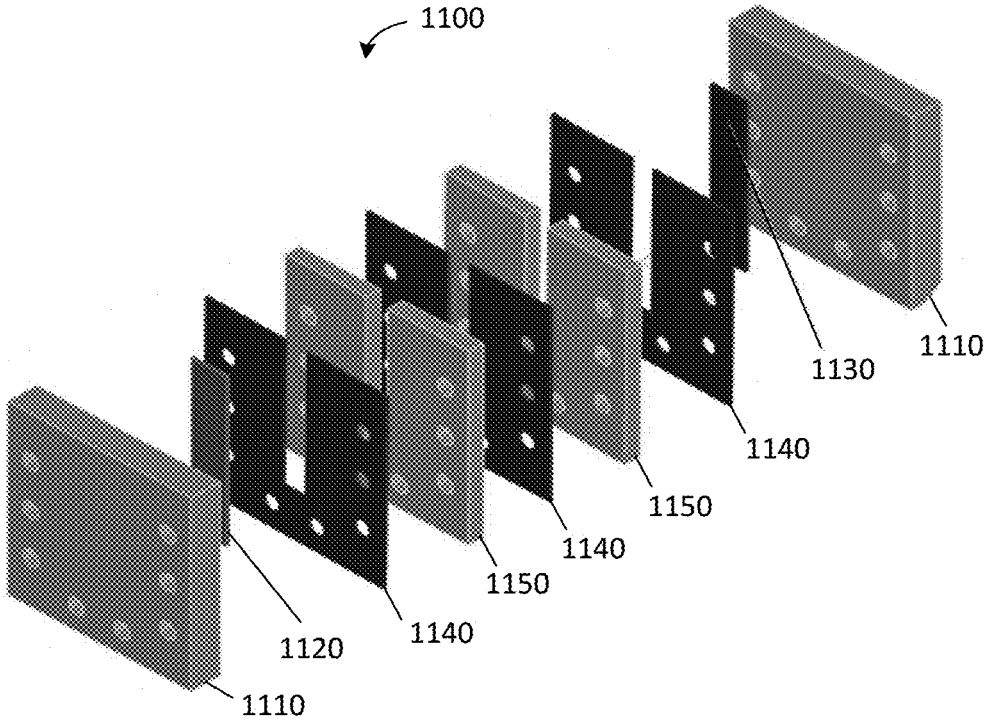
FIG. 11 is an exploded schematic diagram of an exemplary electrochemical cell as disclosed herein.

Cell Assembly: A cell 1100, as illustrated in FIG. 11, was assembled using ¼" (0.64 cm) stainless steel bolts and nylon washers. The cell included graphite blocks 1110 at each end, an anode 1120, a cathode 1130, and a series of Viton™ (DuPont) synthetic rubber and fluoropolymer elastomer gaskets 1140 and polyether ether ketone (PEEK) spacers 1150. In the exemplary cell, the graphite blocks 1110 were 8 cm square and 1.27 cm thick. The gaskets 1140 were 8 cm square and 0.05 cm thick. The spacers 1150 were 8 cm square and cm thick. Silicone resistive heating mats were fixed to either side of the cell and the temperature was monitored with an embedded thermocouple in the graphite plate. A Nafion™ 117 (DuPont) fluorinated membrane (not shown) stored in deionized water was placed between the two PEEK spacers 1150 to divide the cell 1000 into an anode and cathode compartment.

Electrolysis: The cell was heated in the dry state to a temperature of 80° C. at which point the anolyte and catholyte were added to the chamber. All solutions were prepared with deionized water having a resistivity >18 MΩ. The anolyte consisted of 20% w/w NaCl solution in deionized water. The catholyte consisted of a 30% w/w NaOH solution in deionized water. 2.5 mL of solution was mixed with 0.3 g of $Fe_2O_3$ powder prior to addition to the cathode chamber. Current and voltage supplied to the cell was controlled with a BioLogic SP300 Potentiostat (Seyssinet-Pariset, France). Bulk electrolysis was carried out at various applied current densities for 30 or 60 minutes with the faradaic efficiency of Fe plating estimated via changes in mass at the cathode after the electrode had been rinsed thoroughly in deionized water and briefly dried at 100° C.

Half-Cell Analysis

Figure 12:
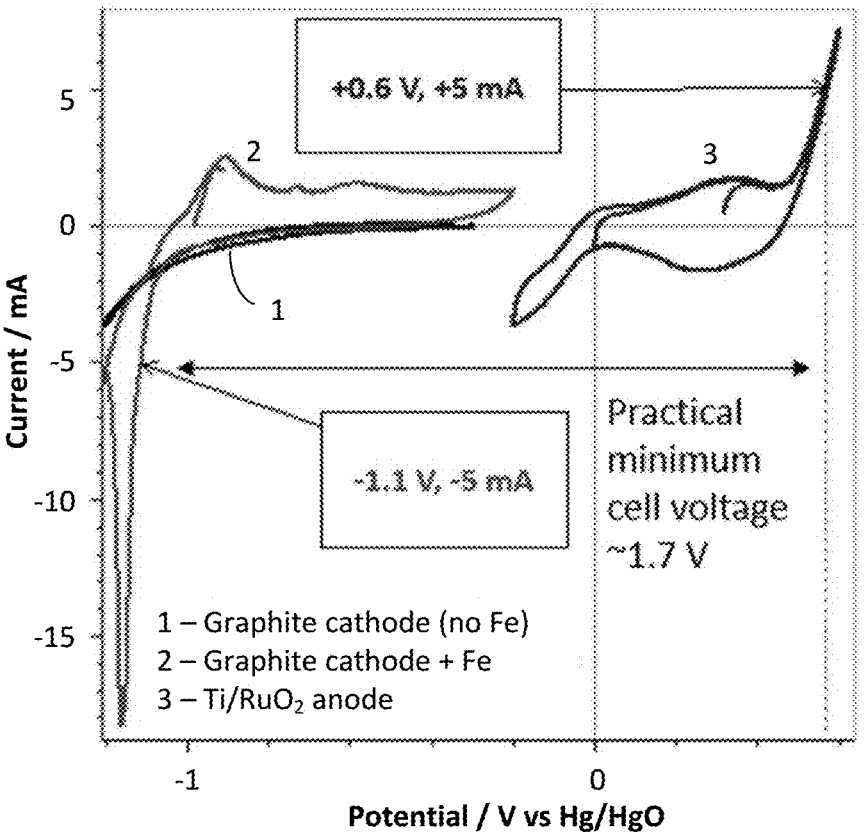
FIG. 12 is a graph showing half-cell measurements for iron plated at a graphite cathode and $Cl_2/O_2$ evolved at a $Ti/RuO_2$ anode.

Kinetic overpotentials for the Fe plating reaction and chlorine evolving reaction were measured at a graphite cathode and Ti/$RuO_2$ anode (Example 1), respectively, to obtain information about the practical minimum cell voltage in the absence of resistances through the electrolyte and membrane but accounting for kinetic overpotentials. The catholyte consisted of 30% w/w NaOH+$Fe_2O_3$ in deionized water (Example 1), and the anolyte consisted of 20% w/w NaOH in deionized water. The current-voltage behavior of a graphite cathode in 30% w/w NaOH in the absence of $Fe_2O_3$ has been included for comparison. The results are shown in FIG. 12. The data support the predicted practical range of operating voltages. For a cell resistance between 3-7 Ω/$cm^2$ (inclusive of electrolyte resistance and leads) operating at currents between 0.1 and 0.3 A/$cm^2$ the predicted cell voltage would be between 2-3.8 V. This was calculated by adding the corresponding minimum and maximum ohmic overpotentials to the measured practical minimum cell voltage. Implicit is an assumption that the kinetic overpotentials will contribute negligibly compared to ohmic overpotentials and that mass transfer overpotentials will be insignificant in the concentrated electrolytes used.

Full Cell Electrolysis

Figure 13A:
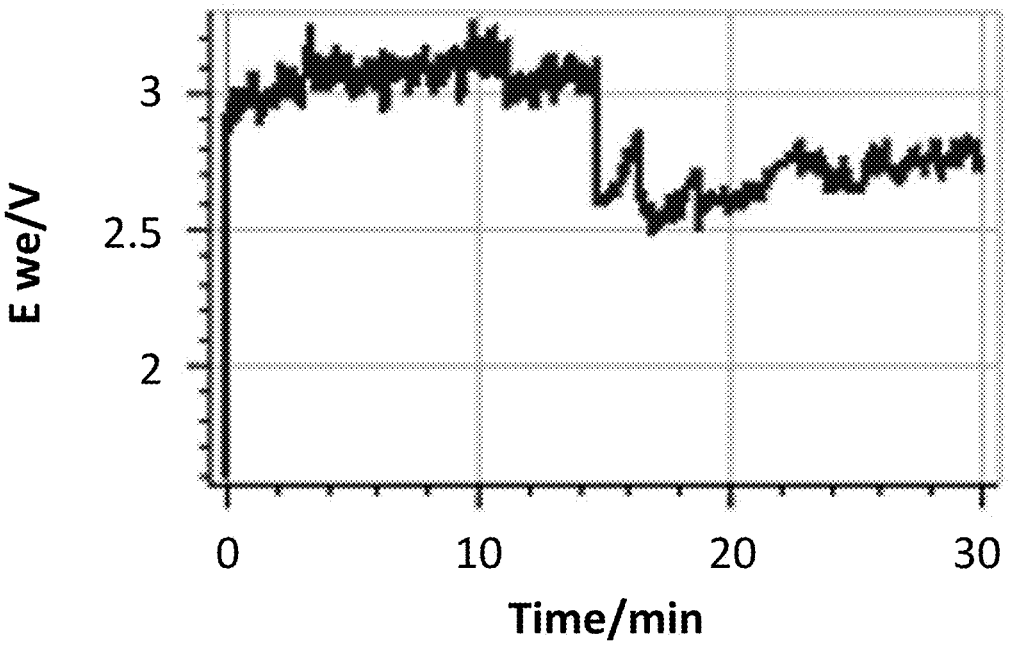
FIGS. 13A and 13B show measured cell potential over time for a full cell with a constant applied current of 100 mA (FIG. 13A), and a microscopy image of iron sponge formed at the cathode along with a small quantity of red $Fe_2O_3$ (FIG. 13B).
Figure 13B:
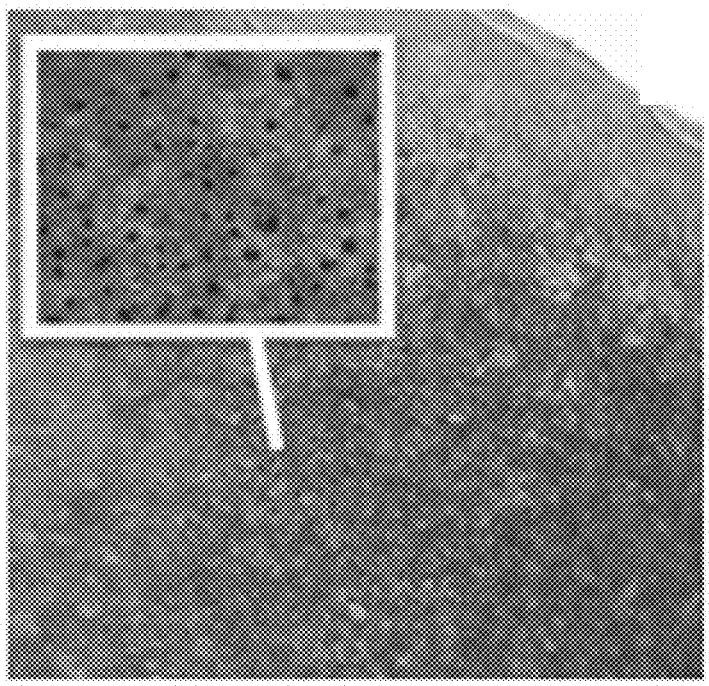

The cell of FIG. 11 was assembled and tested at constant current at a temperature of ° C. The measured cell resistance was 3.6 ohms in the absence of evolved gas bubbles (which are known to contribute substantially to the cell resistance under operation). The approximate geometric area of the cell was 2 $cm^2$ defined by the area of the two metallic electrodes. A constant current of 100 mA (equivalent to a nominal current density of 50 mA/$cm^2$ was applied) for 30 min at a time-averaged cell voltage of 2.9 V (FIG. 13A). The formation of iron-sponge at the cathode was evident (FIG. 13B) and gases were continuously evolved at both the anode and cathode but not yet collected for quantification. The selectivity towards Fe production was 51% based on the measured change in mass at the cathode relative to the expected change in mass for a 100% conversion of all charge passed toward the three-electron reduction of $Fe_2O_3$ to Fe metal.

Example 2

Materials: α-$Fe_2O_3$ (98% purity, metals basis), NaOH (Extra Pure, 50.0 wt % aq), $Al_2O_3$ (99.7%, <0.04% $SiO_2$), and anhydrous $RuCl_3$ (47.7% min), were purchased from Thermo Scientific, whereas HCl (ACS Grade), and NaCl (ACS Grade) were purchased from Fisher Scientific. $SiO_2$ was purchased from U.S. Nano. Nafion® 115 and GI-N417 membranes were purchased from Fuel Cell Store, a Zirfon® UTP-500 membrane was provided by Agfa, and an N2030 membrane was provided by Chemours. Ti foil (99.99%) was purchased from Futiantian Technology Co. and Cu foil (99.99%) from MTI Corporation. A representative commercial-grade iron oxide powder was purchased from Alpha Chemical. KBr was sourced from J.T. Baker and Methyl Orange (97%) from Aldrich. All solutions were prepared using water from a Millipore® deionized water system having a resistivity >18.1 MΩ.

Anode preparation: Ti-supported $RuO_x$ served as $Cl_2$ evolving anodes and were prepared following the method of Trasatti (*J. Electroanal. Chem. Interfacial Electrochem.* 1971, 29(2):A1-A5). Briefly, 80 mg of $RuCl_3$ was dissolved in 20 mL of 20 wt % HCl(aq) and then heated to evaporate excess liquid, yielding a dark residue, free of visible particles. This residue was resuspended in 5 mL of isopropyl alcohol to form a Ru(III) ink and stored in the dark at room temperature until use. Ti foils were soaked in 20 wt % HCl(aq) for 10 min and then repeatedly brush-coated with the Ru(III) ink, dried on a hot plate at 150° C., and suspended in stagnant air within an upright furnace at 400° C. for 10 min. The coating, drying, and oxidation process was repeated until the catalyst loading was ~2 mg/$cm^2$.

Cell Assembly: A cell 1100, as illustrated in FIG. 11, was assembled using ¼" (0.64 cm) stainless steel bolts and nylon washers. The cell included graphite blocks 1110 at each end, an anode 1120, a cathode 1130, and a series of Viton™ (DuPont) synthetic rubber and fluoropolymer elastomer gaskets 1140 and polyether ether ketone (PEEK) spacers 1150. In the exemplary cell, the graphite blocks 1110 were 8 cm square and 1.27 cm thick. The gaskets 1140 were 8 cm square and 0.05 cm thick. The spacers 1150 were 8 cm square and 0.635 cm thick. Silicone resistive heating mats were fixed to either side of the cell and the temperature was monitored with an embedded thermocouple in the graphite plate. A Nafion™ 117 (DuPont) fluorinated membrane (not shown) stored in deionized water was placed between the two PEEK spacers 1150 to divide the cell 1000 into an anode and cathode compartment.

Electrolysis: The cell was heated in the dry state to a temperature of 80° C. at which point the anolyte and catholyte were added to the chamber. All solutions were prepared with deionized water having a resistivity >18 MΩ. The anolyte consisted of 20% w/w NaCl solution in deionized water. The catholyte consisted of a 30% w/w NaOH solution in deionized water. 2.5 mL of solution was mixed with 0.3 g of $Fe_2O_3$ powder prior to addition to the cathode chamber. Current and voltage supplied to the cell was controlled with a BioLogic SP300 Potentiostat (Seyssinet-Pariset, France). Bulk electrolysis was carried out at various applied current densities for 30 or 60 minutes with the faradaic efficiency of Fe plating estimated via changes in mass at the cathode after the electrode had been rinsed thoroughly in deionized water and briefly dried at 100° C.

Example 3

The materials and method of anode preparation were the same as in Example 2 but with a modified design for the electrochemical cell and operating procedure as detailed below.

Electrochemical cell and characterization: The electrochemical cell was prepared from two graphite plates supporting a polished Cu foil cathode, a Ti/$RuO_x$ anode, neoprene rubber gaskets, polyether ether ketone (PEEK) plates, and a cation-exchange membrane. The anode and cathode compartments were defined by 6 mm thick polyether ether ketone (PEEK) spacers and were separated by a cation-selective membrane. A bilayer membrane (Nafion™ N2030 membrane, Chemours, Wilmington, DE), designed to prevent hydroxide crossover in commercial chlor-alkali cells was used to separate the compartments of the flow cell. All cells were externally heated to 80° C. through a silicone heating mat (Omega Engineering) fixed to graphite end-plates in contact with the current collectors. A thermocouple was inserted into the graphite plate to measure the cell temperature and give feedback to a simple controller providing power to the heating pads.

Current was supplied to the cell from a programmable DC power supply and voltage was recorded using a Biologic SP200 potentiostat. The standard catholyte was an alkaline suspension of 25 wt % α-$Fe_2O_3$ mixed with 7.5 mol/kg NaOH(aq) and the anolyte was 5.7 mol/kg NaCl(aq) adjusted to pH=2 using 1 M HCl(aq). The effects of impurities were measured with a wt % suspension of $SiO_2/Al_2O_3/Fe_2O_3$ in 7.5 mol/kg NaOH(aq), where the mass fraction of $SiO_2$ or $Al_2O_3$ was expressed relative to the mass of the solids prior to addition to the basic catholyte.

Cathode conditions: A batch cell separated by a Nafion® 115 (Chemours) membrane was used to determine optimal current density conditions for Fe plating. At J<100 mA $cm^{-2}$, a BioLogic SP300 potentiostat (BioLogic, Seyssinet-Pariset, France) supplied the current and recorded voltage. For J>100 mA $cm^{-2}$, a 30V-10A benchtop power supply provided the provided current and a Biologic SP300 recorded voltage. The temperature of the cell was monitored with a negative temperature coefficient thermistor and controlled using a voltage relay connected to silicone heating mats integrated with the cell. The plating efficiency was determined from the weight of the washed and dried cathode post-plating, as the composition of Fe by mass was consistently in excess of 95%.

Impurity testing: The source of Fe used for the catholyte suspension impacted the performance of the cell. A high purity source of $Fe_2O_3$ (Thermo Scientific) was used as the baseline and led to a substantially increased faradaic efficiency towards Fe in comparison to a lower purity red iron oxide powder (Alpha Chemicals). The effect of metal oxide impurities on Fe electrolysis was studied using a factorial experiment with a single replicate and a randomized run order that screened for primary and cross effects of $SiO_2$, $Al_2O_3$, and current density J. The maximum concentration of metal oxide was selected based on the concentrations present in the "commercial grade" ore (8 wt % $SiO_2$ and 4 wt % $Al_2O_3$), which was found to lead to low (~15%) current efficiency towards Fe. Further investigation of $SiO_2$ contamination was conducted after it was identified as a critical parameter influencing $\eta_{Fe}$. Despite the direct, inverse relationship between the $SiO_2$ content in the electrolyte and the plating efficiency of Fe, Si was not detected in the films using an electron probe microanalyzer (EPMA).

Symmetric cell for anode evaluation: A mirrored cell with NaCl acid solution on both sides of the Nafion® membrane was used to evaluate the dependence of $\eta_{Cl2}$ on J. For safety, $Cl_2$(g) leaving in the anode effluent was immediately quenched in >10 wt % NaOH. After the anode gas production cleared the effluent tube, the tube was rinsed with DI water and then submerged in the methyl orange solution to quantify $Cl_2$(g) production via endpoint detection.

Quantifying chlorine production: Chlorine produced in a flow cell separated by an N2030 membrane (Chemours) was quantified using endpoint detection via oxidation of a methyl orange indicator solution (Wintrich et al., *ChemElectroChem* 2019, 6(12):3108-3112). A stock solution was prepared by dissolving 0.050 g of methyl orange and 0.25 g of KBr in 0.050 L of water and then mixing with 0.010 L of ethylene glycol. A stock solution was prepared by diluting 1:3 (v/v) using 0.100 L of 0.50 M $H_2O_4$(aq) and 1.0 mL of 3.0 wt % $H_2O_2$(aq). The indicator solution was prepared by diluting the stock solution to 1 L with deionized $H_2O$ and $Cl_2$ was quantified using endpoint detection in 0.100 L aliquots of the indicator solution. The initial color and the bleached color are shown in Figure S6 and the transition during titration with $Cl_2$ gas was rapid, occurring in less than a second. During a typical electrolysis experiment at 0.100 A/$cm^{-2}$, the endpoint was reached in ~20 seconds such that the faradaic efficiency estimate represents an average efficiency during 20 seconds of electrolysis. $Cl_2$(g) produced in the cells was immediately reacted with titrant or quenched in a chilled, alkaline bath prior to disposal.

Results

Figure 14A:
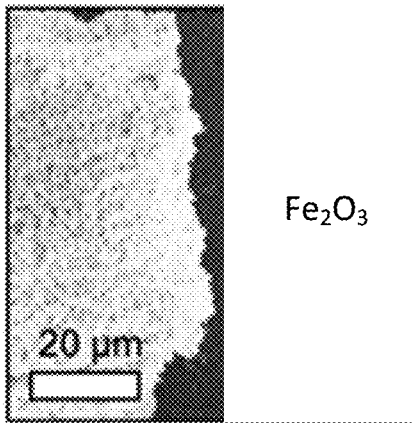
FIGS. 14A and 14B are scanning electron microscopy (SEM) images of $\alpha$-$Fe_2O_3$ aggregate particles (FIG. 14A) consisting of nanoscale primary particles (FIG. 14B).
Figure 14B:
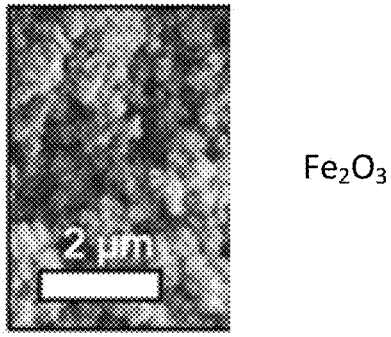
Figure 15A:
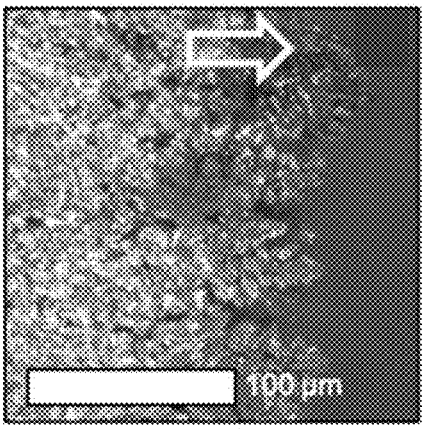
FIGS. 15A and 15B are an optical microscope cross-section image of deposited Fe (gray) on a cathode showing adsorbed $Fe_2O_3$ (red) on the growth surface (FIG. 15A) and an SEM image of Fe plated at 100 mA $cm^{-2}$ (FIG. 15B).
Figure 15B:
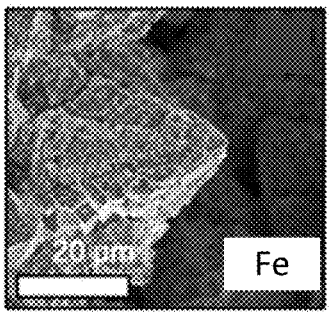
Figure 16A:
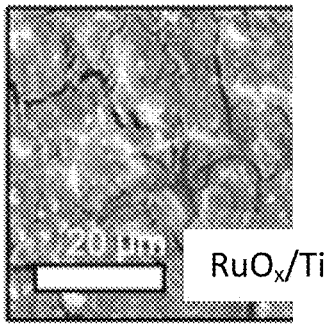
FIGS. 16A and 16B are an SEM image showing an as-deposited $RuO_x$ surface as an anodic catalyst (FIG. 16A) and an SEM image of a cross-section of the Ti-supported $RuO_x$ catalyst layer (FIG. 16B); the cross-section was prepared by milling with a Ga-focused ion beam.
Figure 16B:
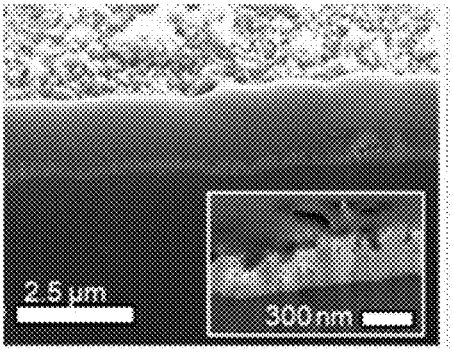

A batch-reactor prototype similar to the cell of FIG. 11 was prepared with a cation-selective Nafion® 115 membrane as the separator. The iron source was $\alpha$-$Fe_2O_3$ aggregate particles having a diameter in micrometers and composed of primary nanoparticles (FIGS. 14A, 14B), that were suspended in a strongly basic electrolyte of 7.5 mol/kg NaOH, pH>14. The metallic cathode product was collected as a solid metal film attached to the current collector (FIGS. 15A, 15B). The anode chamber contained an acidified brine (5.7 mol/kg NaCl, pH 2). A thin film of $RuO_x$, prepared via thermal decomposition of $RuCl_3$ at 400° C. on a Ti current collector, served as the anode (FIGS. 16A, 16B). The cell was operated at 100 mA $cm^{-2}$.

Figure 17A:
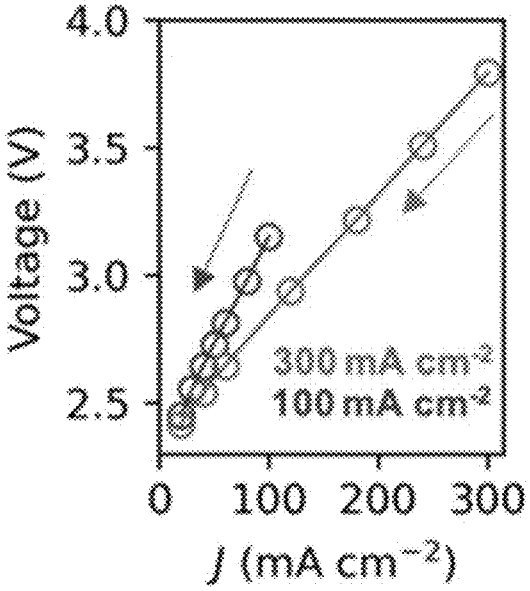
FIGS. 17A-17D show current-voltage behavior of a batch chlorine-iron (chlor-iron) cell.
Figure 17B:
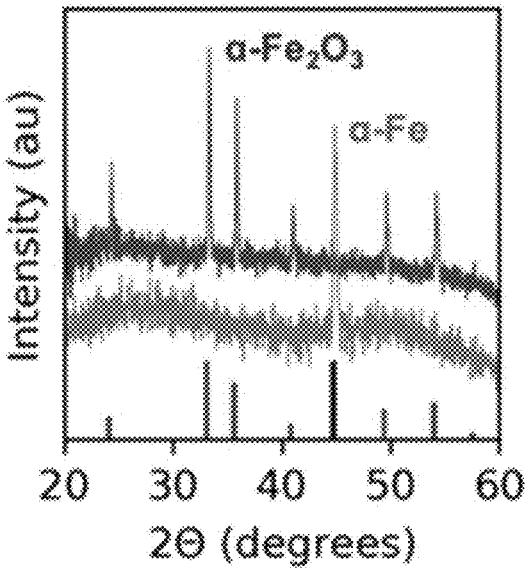

FIG. 17A shows the polarization behavior of the chlor-iron process after two separate 30 min electrolysis experiments at 100 mA $cm^{-2}$ and 300 mA $cm^{-2}$ in a batch chlor-ion cell charged with 25 wt % $\alpha$-$Fe_2O_3$, 7.5 mol/kg NaOH(aq) in the catholyte and 6 mol/kg NaCl in the anolyte separated by a Nafion® 115 membrane and externally heated to 80° C. The onset of the Faradaic efficiency towards Fe, $\eta_{Fe}$ was evaluated based on the mass of Fe collected from the current collector. The product purity and phase composition Fe films were analyzed using X-ray diffraction (XRD), electron probe microanalysis (EPMA), and energy-dispersive X-ray analysis (EDX). The Fe content in the film as measured by EPMA, 96.8(6)%, and (EDX), 98.3(7)%, was consistent with films composed primarily of metallic Fe with a small amount of oxide present either on the film surface (FIG. 18) or as inclusions within the film. XRD patterns (FIG. 17B) of the reactant powder (upper tracing) were compared to a crushed product film after the top layer was scraped from the surface (lower tracing) showing only the presence of $\alpha$-$Fe_2O_3$ in the reactant while the metallic product exhibited a single peak assigned to $\alpha$-Fe(110).

Figure 17C:
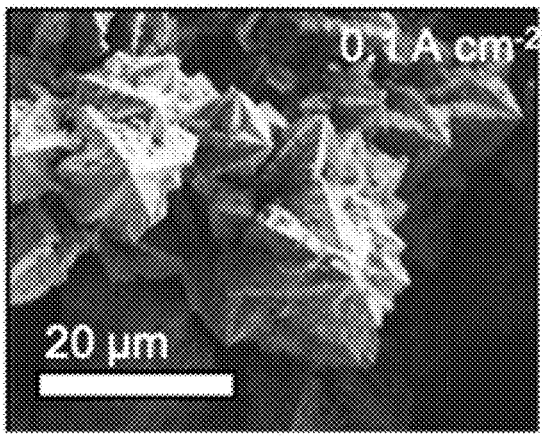
Figure 17D:
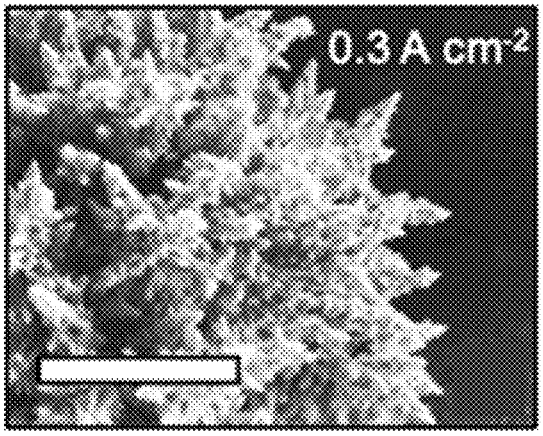

The morphology of reduced Fe was dependent on J. Films deposited at 100 mA $cm^{-2}$ were largely free of pinholes with limited branching within the film microstructure. Secondary particles of Fe within the film structure were generally tens of micrometers in diameter (FIGS. 17C, 19A, 19C). The morphology of films produced at 300 mA $cm^{-2}$ contained a surface base layer with multiple 30 μm diameter pinholes (FIGS. 17D, 19B, 19D) that extended to the current collector surface.

Figure 20A:
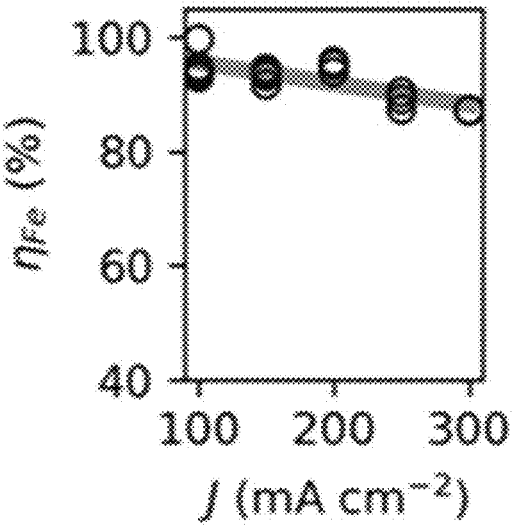
FIGS. 20A-20D show process parameters and sensitivities of a batch chlor-iron cell with a Nafion® 115 membrane separator.

The hydrogen evolution reaction and oxygen evolution reaction compete with the cathodic and anodic reactions in the chlor-iron cell, respectively, and so the selectivity towards the desired Fe and $Cl_2$ products at the $RuO_x$ surface as a function of J was evaluated (Adiga et al., *Mater. Today Energy* 2022, 28:101087). As shown in FIG. 20A, $\eta_{Fe}$>85% was sustained for current densities 100-300 mA $cm^{-2}$. The selectivity towards iron plating, $\eta_{Fe}$, was >94% for J≤200 mA $cm^{-2}$ and $\eta_{Fe}$ decreased to 87% at 300 mA $cm^{-2}$.

To evaluate the impact of common contaminants, $SiO_2$ and $Al_2O_3$ particles were blended with purified $\alpha$-$Fe_2O_3$ as feedstocks for the chlor-iron cell. At J=100 mA $cm^{-2}$, $\eta_{Fe}$ was inversely proportional to the quantity of $SiO_2$ fed to the cell (FIG. 20C), although the polarization behavior was largely unaffected by $SiO_2$. At an increased J of 300 mA $cm^{-2}$, 8 wt % $SiO_2$ in the catholyte led to an $\eta_{Fe}$<37% during electrolysis (Table 2). Each condition was measured with one replicate, with $\eta_{Fe}$ measured after 30 minutes of continuous electrolysis. The addition of $Al_2O_3$ at 4 wt % did not significantly impact $\eta_{Fe}$ at either J.

TABLE 2

Measured $\eta_{Fe}$ as a function of intentionally added $SiO_2$ and $Al_2O_3$ impurities to reactant $Fe_2O_3$.

| $SiO_2$ wt % | $Al_2O_3$ wt % | $\eta_{Fe}$ (%) |
|---|---|---|
| $\eta_{Fe}$ vs metal oxide concentration at 100 mA $cm^{-2}$ | | |
| 0 | 0 | 94, 95 |
| 0 | 4 | 95, 95 |
| 8 | 0 | 58, 57 |
| 8 | 4 | 57, 54 |
| $\eta_{Fe}$ vs metal oxide concentration at 300 mA $cm^{-2}$ | | |
| 0 | 0 | 87, 87 |
| 0 | 4 | 88, 93 |
| 8 | 0 | 36, 37 |
| 8 | 4 | 39, 41 |

An electrochemical flow cell that maintained constant electrolyte volumes and concentrations was prepared for longer duration evaluation of the chlor-iron process and also enabled continuous collection of $Cl_2$(g) for measurement of $\eta_{Cl2}$ prior to quenching. The direction of flow within the cell was aligned vertically with respect to gravity during operation with electrolyte pumped in through the base of the cell. Expelled electrolyte due to gas evolution in the cathode chamber was collected and stored, while $Cl_2$(g) was quenched in either a methyl-orange indicator solution used to measure $\eta_{Cl2}$ via endpoint detection (Wintrich et al., *ChemElectroChem* 2019, 6:3108-3112), or an alkaline solution that rapidly converted $Cl_2$(g) to soluble $HClO/ClO^-$. Pre-heated catholyte and anolyte were slowly pumped into the flow cell which was maintained at a fixed temperature using external silicone heating pads. Gaseous effluent from the anode compartment was quenched in a large beaker containing aqueous NaOH until bubbling reached a steady state. The effluent was then passed to a 1 L beaker containing a stirred methyl orange indicator solution, which rapidly bleached upon reaching a fixed endpoint. The time required to reach the endpoint was used to calculate a molar flux of chlorine which was compared to the applied J to calculate a Faradaic efficiency for the cell.

Figure 22:
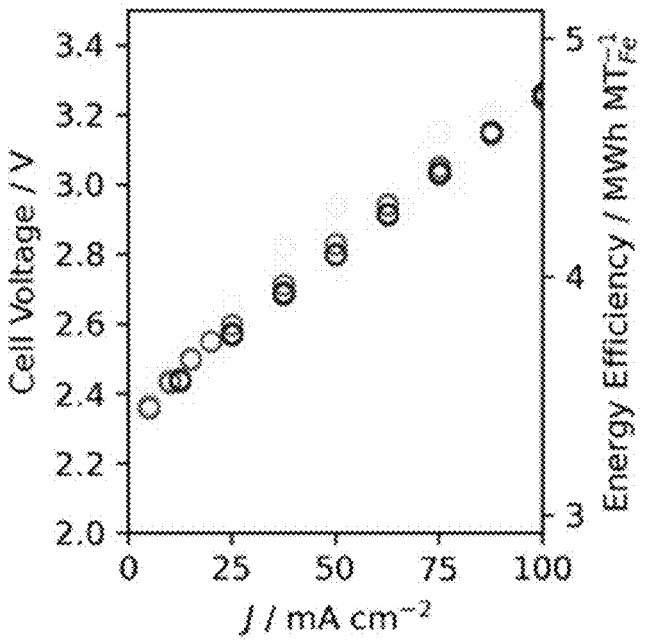
FIG. 22 compares the polarization behavior of the chlor-iron flow cell of FIGS. 21A-21B after 30 min of electrolysis at J=100 mA $cm^{-2}$ and 4 hours of electrolysis at J=100 mA $cm^{-2}$; the maximum energy efficiency was computed assuming unity Faradaic efficiency towards products.
Figure 23A:
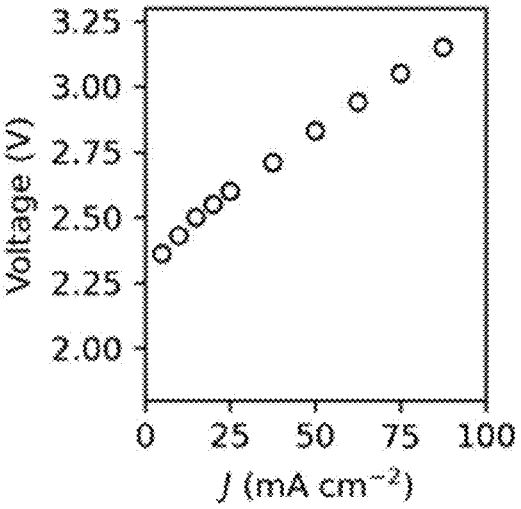
FIGS. 23A-23E shows performance of a continuous flow chlor-iron cell including an N2030 bilayer membrane separator.
Figure 23B:
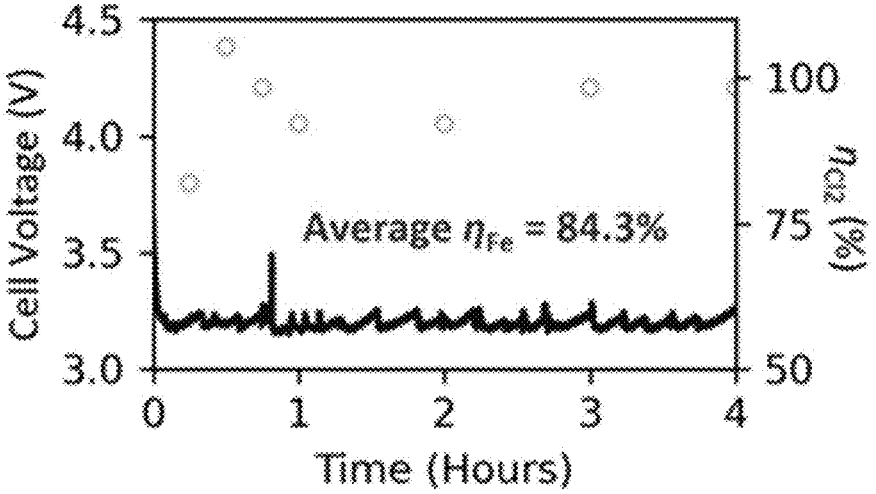
Figure 23C:
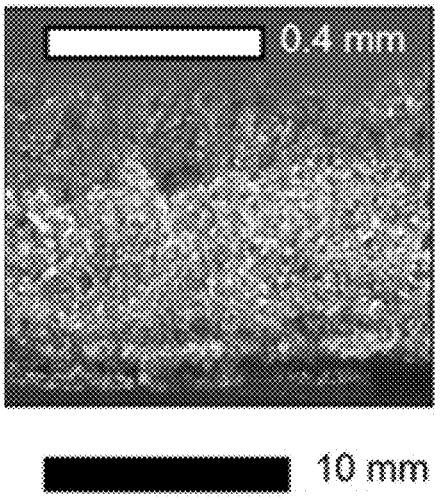
Figure 23D:
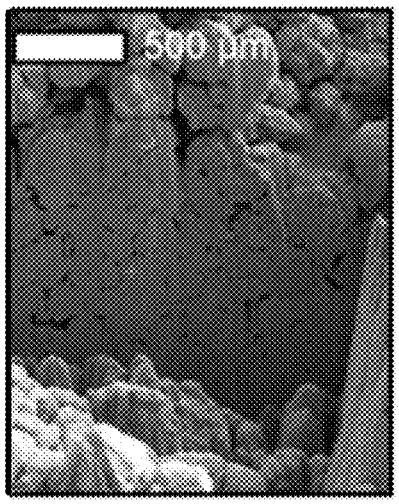
Figure 23E:
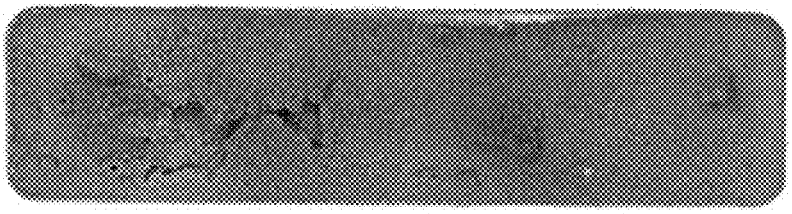

A bilayer membrane designed for the chlor-alkali process (N2030, Chemours) maintained an acidic pH environment at the anolyte. The cell voltage was consistent at ~3.2 V throughout a 4 h constant current experiment at 100 mA $cm^{-2}$, whereas the measured $\eta_{Cl2}$ ranged from 82-105% during the first 20 min of reaction before stabilizing at 95(3)% from hours 1-4 and the average $\eta_{Fe}$ was 84%. The polarization behavior of the cell after testing was similar to the polarization behavior measured after 30 min (FIG. 22). The Fe films produced in multi-hour reactions were easily detached from the current collector surface as a free-standing film (FIGS. 23C and 23D). SEM and optical microscopy revealed films mostly consisting of dense Fe metal particles, having diameters ~10-50 μm with a sparse population of voids having diameters <10 μm (FIG. 23C).

Discussion

Figure 21A:
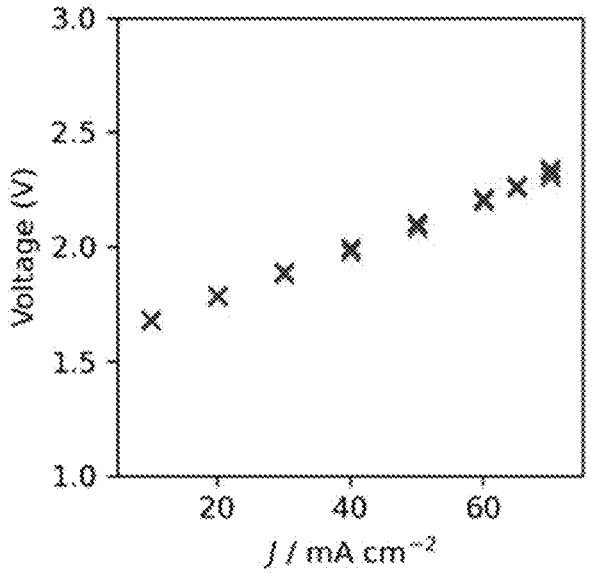
FIGS. 21A and 21B show the current-voltage performance of a chlor-iron cell separated by a porous diaphragm (Zirfon® PERL UTP 500 separator).
Figure 21B:
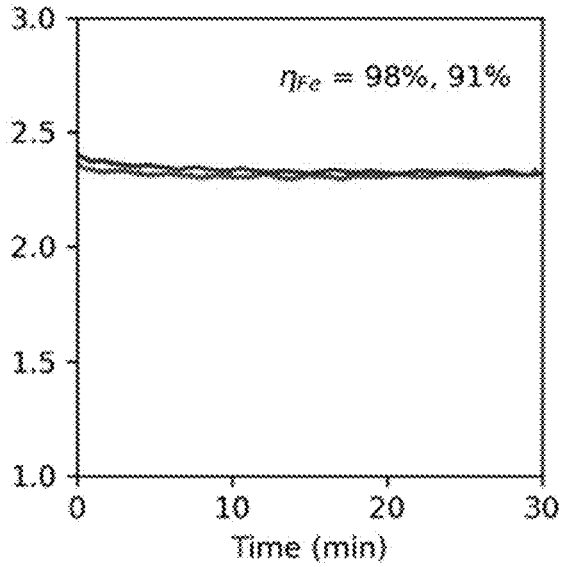

Fe and $Cl_2$(g) were produced at J=100 mA $cm^{-2}$ and $\eta$>90% such that the coupling of the anodic and cathodic reactions did not preclude independent production and collection of Fe and $Cl_2$ (FIGS. 14A, 14B, 15A, 15B, 16A, 16B, 23A-23E). Cells separated by a conventional cation-exchange membrane (FIG. 20A), a porous diaphragm (FIG. 21B), and a specialty bilayer cation exchange membrane (FIG. 23C) all yielded $\eta_{Fe}$>90%, (28, 29, 38), indicating that $Cl^-$ crossover through the cation-selective membrane was marginal or else had a marginal effect on the Fe-plating reaction. The chlorine evolution reaction was most significantly affected by the anolyte pH, and the use of a specialty bilayer membrane (N2030, Chemours) prevented crossover of the 7.5 mol/kg NaOH in the catholyte through the membrane to the dilute acid in the anolyte. The large pH gradient between the anolyte and catholyte led to an increase in the operating cell voltage (>3 V) relative to a cell producing only Fe and $O_2$ from a single, alkaline electrolyte (1.7 V) (Leduc et al., *J. Electrochem. Soc.* 1959, 106:659; Allanore et al., *J. Appl. Electrochem.* 2010, 40:1957-1966). Future work will further evaluate the role of reactant oxide phase and particle diameter, the influence of cathode morphology on polarizability, and improved gas release from the anode and cathode to minimize cell resistance. (FIG. 17A).

Figure 20B:
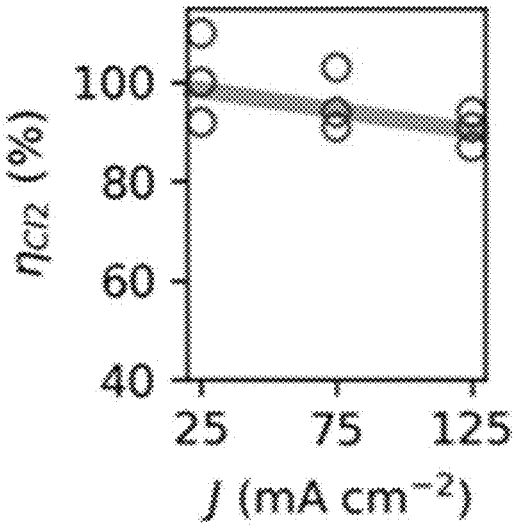

A technoeconomic analysis of the levelized cost of electrolytic iron assumed plants constructed at a similar capital cost to existing chlor-alkali plants (Stinn et al., *Electrochem. Soc. Interface* 2020, 29:44; Manfield et al., "Economic Analysis of Air Pollution Regulations: Chlorine Industry, 2000). The assumption is based on the similar operating conditions and bill of materials of the chlor-iron and chlor-alkali processes. The operating voltages and $\eta_{Cl2}$ obtained in the 4 $cm^2$ cell were used for the base case (FIG. 23B), and the sensitivity of the cost of iron to changes in $\eta$, the capital cost of the plant, the cost of iron ore, the cost of electric power, the cell voltage, and the cell lifetime are reported. For industrial electricity prices ~$75/MWh, the levelized cost of iron is most sensitive to the capital cost of the plant and $\eta$, but is relatively insensitive to the cell voltage and replacement schedule. This finding suggests that increased electricity costs due to increased cell voltage, provided that they enable effective stack costs (on a $ $MT^{-1}$ capacity basis) that are comparable to industrial chlor-alkali cells, are preferable to reach minimum costs for iron production. Both $\eta_{Fe}$ and $\eta_{Cl2}$ are sensitive to cell operating conditions (FIGS. 20A-20C), and additives may facilitate increased throughput without commensurate tradeoffs in product selectivity.

Figure 20C:
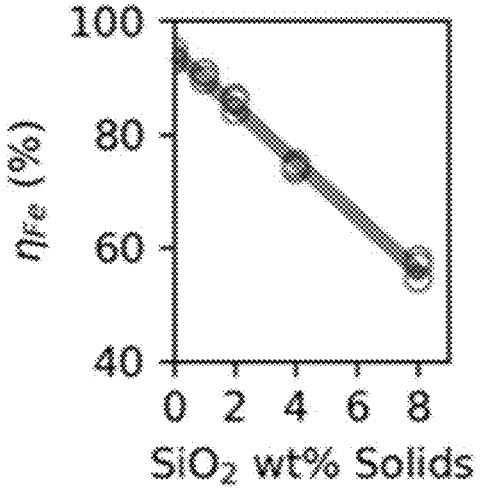
Figure 20D:
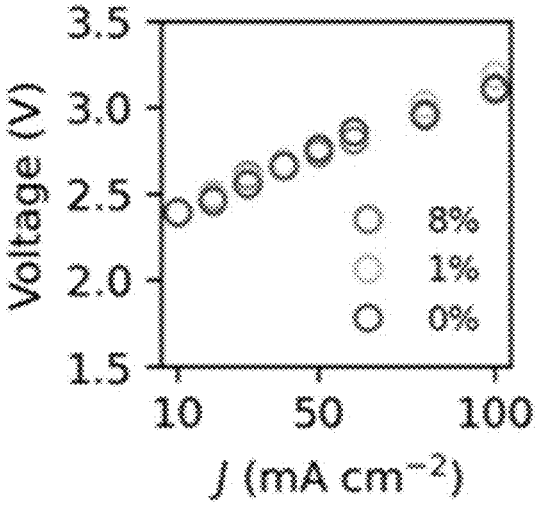

The presence of $SiO_2$ within the catholyte did not appear to influence the polarization behavior of the cell (FIG. 20D) and was not incorporated into the film but led to a substantially reduced $\eta_{Fe}$ (FIG. 20C). It may be beneficial to first remove $SiO_2$ from low-purity iron oxide ores to <2 wt % in order to yield catholyte conditions that enable $\eta_{Fe}$>90%. Nevertheless, aspects of the disclosed chlor-iron process may be tolerant to lower-grade ores if co-product NaOH is used to pre-leach aluminates and silicate, which are soluble in concentrated alkali solutions, from the feed.

Although a Ti-supported $RuO_x$ anode was used in this example, commercialized anodes intended for the chloro-alali process may yield similar efficiencies and improved durability, in the absence of significant crossover of $OH^-$ or dissolved metal oxides. The materials for anodic electrocatalyst films, current collectors, and membranes used in the disclosed exemplary chlor-iron electrochemical cells are commercially available. Implementations of the disclosed method could be scaled along parallel manufacturing process or even as a retrofit of existing chlor-alkali process systems.

The generation of hydroxide ions at the cathode that are not consumed at the anode leads to a process that is a net-producer of a metal hydroxide as opposed to a net-consumer of metal hydroxides or acids. Separation costs associated with Fe and $Cl_2$(g) are expected to be marginal. In this example, although the generated NaOH includes metal/metal-oxide impurities, the low-purity NaOH could be used as a purifying reagent for commercial-grade iron ore (e.g., to leach out $SiO_2$), or even used to capture and mineralize $CO_2$, leading to a net-negative process for ironmaking thereby offsetting downstream emissions associated with steelmaking (Keith et al., *Joule* 2018, 2:1573-1594).

Figure 24A:
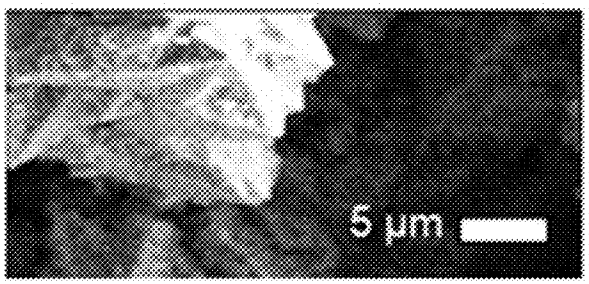
FIGS. 24A and 24B show elemental analysis of iron particles produced in an exemplary chlor-iron cell.
Figure 24B:
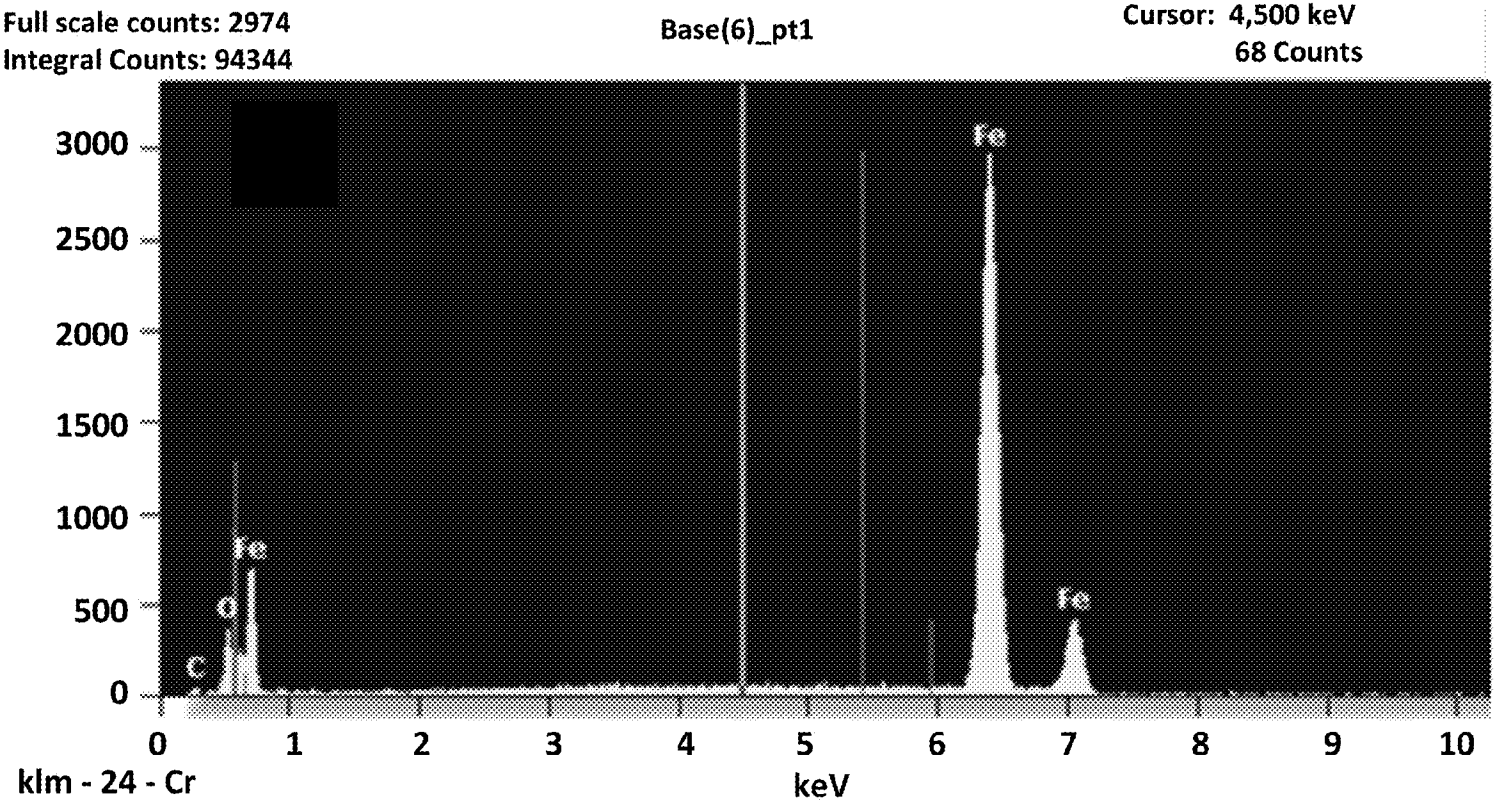

The preferred morphology, purity, and throughput for Fe deposition may depend on the intended use of the Fe films. The morphology (particle diameter ~10-50 μm) and purity (>95%) of the Fe produced is consistent with direct-reduced iron sponge used as a feedstock for electric arc furnaces (FIGS. 24A-24B, Table 3) (Raabe et al., *Nature* 2019, 575:64-74). Some aspects of the disclosed method could also be used to produce high surface area, monolithic iron electrodes for use in aqueous metal-air batteries.

TABLE 3

| Species | C | O | Fe |
|---|---|---|---|
| wt % | 0.3 | 1.4 | 98.3 |
| atom % | 1.4 | 4.7 | 93.9 |

In summary, embodiments of the disclosed electrochemical cell and process provided a scalable, efficient (<5 MWh $MT_{Fe}^{-1}$), and high-throughput (>100 mA $cm^{-2}$) process for ironmaking that would produce zero or even net-negative direct greenhouse gas (GHG) emissions (FIG. 22). In some aspects, the overall cell reaction advantageously utilizes only low-cost iron oxide and seawater/brine as reactants. Fe was produced as easily collected free-standing films with >95 wt % purity, suitable for use in electric arc furnaces, and $Cl_2$ was collected at industrially-relevant rates and selectivity. The co-production of NaOH is a distinguishing feature of this approach to ironmaking and could be used to purify low-grade iron ore to remove silicates or potentially used in a downstream process for $CO_2$ capture and mineralization, leading to a net-negative GHG emission ironmaking process with the potential to avoid/capture 240 $MMT_{CO2}y^{-1}$.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. An electrowinning process for producing metal and chlorine, comprising:

providing an electrochemical cell comprising (i) a cathode comprising low-carbon steel, copper, iron, graphite, vitreous carbon, or titanium, (ii) an anode comprising an oxide coating comprising Ru, Pt, Ir, or any combination thereof, on a conducting substrate, (iii) a separator between the cathode and the anode, the separator comprising a porous composite or a cation-selective membrane, and (iv) a voltage source electrically connected to the cathode and the anode;

providing a catholyte comprising (i) water, (ii) a metal hydroxide comprising Q, where Q is an alkali metal, an alkaline earth metal, or a combination thereof, and (iii) suspended metal ore particles comprising $M_xO_y$ where M is a metal and x and y are integers;

providing an anolyte comprising water and a metal chloride comprising Q; and applying a voltage across the electrochemical cell to effect reduction of the $M_xO_y$ in the catholyte to provide the metal M and oxidation of chloride ions in the anolyte to form $Cl_2$ gas.

2. The electrowinning process of claim 1, wherein:

(i) M is Fe, Mn, Ni, Cr, Co, Zn, or any combination thereof; or (ii) Q is Na, K, Li, Mg, Ca, or any combination thereof; or (iii) both (i) and (ii).

3. The electrowinning process of claim 1, wherein:

(i) the metal ore particles comprise $Fe_2O_3$; or (ii) Q is Na; or (iii) both (i) and (ii).

4. The electrowinning process of claim 1, wherein (i) the catholyte comprises from 50 g/L to 500 g/L of the suspended metal ore particles prior to applying the voltage; or (ii) the catholyte comprises from 10 wt % to 50 wt % of the metal hydroxide prior to applying the voltage; or (iii) the anolyte comprises from 10 wt % to 50 wt % of the metal chloride prior to applying the voltage; or (iv) any combination of two or more of (i), (ii), and (iii).

5. The electrowinning process of claim 1, further comprising:

continuously or periodically removing $Cl_2$ generated in the anolyte; and periodically removing at least a portion of the metal M from the cathode.

6. The electrowinning process of claim 5, wherein the metal M is magnetic and is deposited onto a surface of the cathode, and periodically removing at least a portion of the metal M comprises:

passing a magnet over the surface of the cathode or over an opposing surface of the cathode; and removing the magnet from the electrochemical cell, whereby the metal M deposited onto the surface of the cathode is transferred to the magnet as the magnet is removed.

7. The electrowinning process of claim 1, further comprising:

(i) periodically adding a quantity of the metal ore particles to the catholyte; or (ii) periodically adding a quantity of the metal chloride to the anolyte; or (iii) both (i) and (ii).

8. The electrowinning process of claim 1, wherein the metal ore particles are obtained from a metal ore feedstock further comprising aluminates, silicates, or aluminates and silicates, the method further comprising leaching at least a portion of the aluminates, silicates, or aluminates and silicates from the metal ore feedstock by contacting the metal ore feedstock with a hydroxide solution to provide the metal ore particles.

9. The electrowinning process of claim 8, wherein the hydroxide solution is a spent catholyte obtained from the electrochemical cell after applying the voltage across the electrochemical cell.

10. The electrowinning process of claim 1, wherein the anolyte comprises concentrated seawater having a metal chloride concentration of from 10 wt % to 50 wt %.

11. The electrowinning process of claim 1, wherein:

providing the electrochemical cell further comprises providing a cell stack comprising (i) a number n of the electrochemical cells, a cathode electrical connector connecting cathodes of each of the electrochemical cells in parallel, an anode electrical connector connecting anodes of each of the electrochemical cells in parallel, and a voltage source electrically connected to the cathode electrical connector and the anode electrical connector, or (ii) a number n of the electrochemical cells, a number n-1 of conductive bipolar plates wherein a conductive bipolar plate is positioned between each adjacent pair of electrochemical cells, a cathode electrical connector connected to a cathode of a first electrochemical cell in the series, an anode electrical connector connected to an anode of a last electrochemical cell in the series, and a voltage source electrically connected to the cathode electrical connector and the anode electrical connector;

providing the catholyte further comprises providing the catholyte within each electrochemical cell of the cell stack;

providing the anolyte further comprises providing the anolyte within each electrochemical cell of the cell stack; and applying a voltage across the electrochemical cell further comprises applying the voltage across the cell stack to effect reduction of the $M_xO_y$ in each cathode compartment to provide the metal M and formation of $Cl_2$ gas in each anode compartment.

12. The electrowinning process of claim 1, wherein:

(i) the voltage applied is from 2 V to 5 V per electrochemical cell; or (ii) the electrochemical cell is operated at a current density of from 20 mA $cm^{-2}$ to 500 mA $cm^{-2}$; or (iii) the electrochemical cell is operated at a temperature from 25° C. to 150° C.; or (iv) any combination of (i), (ii), and (iii).

* * * * *